US008781634B2

(12) United States Patent
Kim et al.

(10) Patent No.: US 8,781,634 B2
(45) Date of Patent: Jul. 15, 2014

(54) AIR CONDITIONING SYSTEM AND COMMUNICATION METHOD THEREOF

(75) Inventors: Juntae Kim, Seoul (KR); Sangchul Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 340 days.

(21) Appl. No.: 13/047,224

(22) Filed: Mar. 14, 2011

(65) Prior Publication Data

US 2011/0224833 A1 Sep. 15, 2011

(30) Foreign Application Priority Data

Mar. 15, 2010 (KR) ..... 10-2010-0022980
Jan. 11, 2011 (KR) ..... 10-2011-0002843

(51) Int. Cl.

| | |
|---|---|
| ***G01M 1/38*** | (2006.01) |
| ***G05B 13/00*** | (2006.01) |
| ***G05B 15/00*** | (2006.01) |
| ***G05D 23/00*** | (2006.01) |

(52) U.S. Cl.

USPC ..... 700/276; 700/277; 700/278; 700/299; 700/300; 165/200; 165/203; 165/248; 165/249; 165/250; 62/132; 62/149; 62/208

(58) Field of Classification Search

CPC ..... F24F 11/006; F24F 2011/0067; F24F 2011/0068

USPC ..... 700/276–278, 299–300; 361/1 B, 1 C, 361/91 R, 98; 165/200–203, 248–250; 62/132, 149, 208; 236/1 B, 1 C, 91 R, 98

See application file for complete search history.

(56) References Cited

U.S. PATENT DOCUMENTS

| | | | | |
|---|---|---|---|---|
| 4,771,610 | A * | 9/1988 | Nakashima et al. | 62/160 |
| 4,932,220 | A * | 6/1990 | Inoue | 62/175 |
| 4,936,107 | A * | 6/1990 | Kitagaki et al. | 62/184 |
| 4,944,156 | A * | 7/1990 | Yamamoto | 62/324.6 |
| 5,282,369 | A * | 2/1994 | Ohuchi et al. | 62/476 |
| 5,317,907 | A * | 6/1994 | Shimizu et al. | 62/176.6 |
| 5,499,510 | A * | 3/1996 | Yoshida et al. | 62/175 |
| 7,287,393 | B2 * | 10/2007 | Kwon et al. | 62/157 |
| 2004/0107717 | A1 * | 6/2004 | Yoon et al. | 62/230 |
| 2004/0255601 | A1 * | 12/2004 | Kwon et al. | 62/157 |
| 2006/0090483 | A1 * | 5/2006 | Kim et al. | 62/126 |

(Continued)

FOREIGN PATENT DOCUMENTS

| | | |
|---|---|---|
| CN | 1767412 | 5/2006 |
| CN | 1952990 A | 4/2007 |
| KR | 10-2004-0045868 | 6/2004 |
| KR | 10-2009-0079078 A | 7/2009 |

*Primary Examiner* — Ramesh Patel

(74) *Attorney, Agent, or Firm* — McKenna Long & Aldridge LLP

(57) ABSTRACT

In an air conditioning system and a communication method thereof a wireless network may be established between indoor units and a controller or between outdoor units so as to allow communications therebetween, thereby facilitating device addition or device deletion. Also, one or more outdoor units and a plurality of indoor units may be controlled without a dedicated communication line or with using a less mount of the dedicated communication line, and the outdoor units or indoor units may perform communications using one or more communication technologies, such as wireless communication and pipe communication technologies and wireless communication and dedicated line communication technologies, while performing communications with the controller using the wireless communication technology.

19 Claims, 19 Drawing Sheets

(56) References Cited

U.S. PATENT DOCUMENTS

| | | | | |
|---|---|---|---|---|
| 2006/0117776 | A1* | 6/2006 | Choi et al. | 62/228.5 |
| 2006/0120036 | A1* | 6/2006 | Rockenfeller | 361/688 |
| 2008/0022710 | A1* | 1/2008 | Jeong et al. | 62/324.6 |
| 2009/0211283 | A1* | 8/2009 | Koh et al. | 62/259.1 |
| 2010/0107665 | A1* | 5/2010 | Kawano et al. | 62/149 |
| 2010/0236263 | A1* | 9/2010 | Park | 62/113 |
| 2010/0317288 | A1* | 12/2010 | Higuma et al. | 455/41.1 |
| 2011/0219798 | A1* | 9/2011 | Kim et al. | 62/129 |
| 2011/0224921 | A1* | 9/2011 | Ko et al. | 702/55 |

* cited by examiner

AIR CONDITIONING SYSTEM AND COMMUNICATION METHOD THEREOF

CROSS-REFERENCE TO RELATED APPLICATION

Pursuant to 35 U.S.C. §119(a), this application claims the benefit of earlier filing date and right of priority to Korean Application Nos. 10-2010-0022980, filed on Mar. 15, 2010, and 10-2011-0002843, filed on Jan. 11, 2011, and the contents of which are incorporated by reference in its entirety for all purposes as if fully set forth herein.

BACKGROUND OF THE INVENTION

1. Field of Disclosure

The present disclosure relates to an air conditioning system, and particularly, to an air conditioning system, capable of performing wireless communications by establishing wireless networks among components, and a communication method thereof.

2. Background of the Invention

In general, an air conditioning system, as shown in FIG. 1, includes outdoor units 20 for controlling distribution and circulation of refrigerant, indoor units 10 linked to the outdoor units 20 for supplying air into each room, and a controller 30 connected to each outdoor unit 20 for control thereof.

The controller 30 may include a control program for allowing a user or other operators to preset air conditioner setting information, such as network information, device information related to the indoor units and the outdoor units, and the like so as to individually control each unit (component) according to the preset setting information.

Recently, air conditioning systems have included a central controller for enhancing management efficiencies of air conditioners installed in public buildings, such as offices, schools, and factories. Also, as the functions of the outdoor units are increased, the tendency is toward linking many indoor units to one outdoor unit and integrally controlling the outdoor and indoor units using the central controller.

In order for a controller, such as a central controller, to perform communications with the outdoor units and the indoor units, communication lines are required. In the related art, the communications with the outdoor units and the indoor units have been performed separately using dedicated lines. Recently, an indoor unit has been configured to transmit and receive data via a power line by employing a power line communication technology, so the indoor unit does not require any separate communication line.

Meanwhile, as the air conditioners are installed in public buildings, the number of indoor units required increases, which causes an increase in the number of outdoor units due to capacity limitation. Here, communication lines are needed for communications between outdoor units, as well as between the controller and the outdoor unit, between the controller and the indoor unit and between the outdoor unit and the indoor unit, accordingly, the connection of the communication lines becomes more complicated.

SUMMARY

Therefore, an aspect of the described embodiment is to provide an air conditioning system capable of performing communications without wired communication lines by establishing (forming, creating) a wireless network between an indoor unit and a controller or between outdoor units, and to provide a communication method thereof.

Another aspect of the described embodiment is to provide an air conditioning system capable of controlling one or more outdoor units and a plurality of indoor units without dedicated communication lines or with less using the dedicated communication lines, and a communication method thereof.

Another aspect of the described embodiment is to provide an air conditioning system capable of allowing communications of outdoor units or indoor units using a plurality of communication technologies, including wireless communication and pipe communication technologies or wireless communication and dedicated line communication technologies, and allowing communications of the outdoor units or indoor units with a controller using a wireless communication technology, and a communication method thereof.

To achieve these and other advantages and in accordance with the purpose of the present embodiment and broadly described herein, there is provided an air conditioning system including a plurality of indoor units for air conditioning, one or more outdoor unit connected to some or all of the indoor units via a refrigerant pipe and configured to drive the indoor units, one or more controllers configured to control operations of the plurality of indoor units and the one or more outdoor units, and a communication unit connected to or equipped at part of the outdoor units or part of the indoor units, and configured to allow communications of the indoor units, the outdoor units and the controllers using a plurality of communication technologies.

In accordance with one aspect, the communication unit may include a first wireless communication module configured to allow communications between the outdoor unit or indoor unit and the controller using a wireless communication technology. The communication unit may further include a pipe communication module configured to allow communications between the outdoor unit and the indoor unit using a pipe communication technology. The communication unit may further include a dedicated line communication module configured to allow communications between the outdoor unit and the indoor unit using a dedicated line communication technology.

In accordance with another aspect, the controller may establish an indoor wireless network with some of the indoor units and perform communications via the indoor wireless network. Here, the air conditioning system may further include an indoor network coordinator disposed within the indoor wireless network and configured to perform communications therein, the indoor network coordinator granting or denying participation of another device in the indoor wireless network.

In accordance with another aspect, upon including a plurality of outdoor units, the outdoor units may establish an outdoor wireless network. Here, the air conditioning system may further include an outdoor network coordinator disposed within the outdoor wireless network and configured to perform communications therein, the outdoor network coordinator granting or denying participation of another device in the outdoor wireless network. The air conditioning system may further include a repeating unit configured to receive and reproduce a signal sent by the outdoor network coordinator and transfer the reproduced signal to another outdoor unit.

In accordance with one aspect, there is provided a communication method for an air conditioning system, including a plurality of indoor units for air conditioning, one or more outdoor unit connected to the indoor units via a refrigerant pipe to drive the indoor units, and a controller configured to control operations of the indoor units and the outdoor units, the method including converting by the controller a control command into a wireless signal, sending by the controller the wireless signal to the outdoor unit or indoor unit, converting by the outdoor unit or indoor unit the wireless signal into a different type of communication signal, and sending by the outdoor unit or indoor unit the different type of communication signal to an outdoor unit or indoor unit as a target of the control command.

The method may further include establishing an indoor wireless network between the controller and some of the indoor units, wherein the sending of the wireless signal may be configured such that the controller sends the wireless signal to an indoor unit via the indoor wireless network, the indoor unit being located within the indoor wireless network.

The method may further include setting one indoor unit present within the indoor wireless network as an indoor network coordinator. Here, the establishing of the indoor wireless network may include searching for wireless channels by the indoor network coordinator, designating by the indoor network coordinator an optimum wireless channel among the wireless channels, receiving by the indoor network coordinator a request for participation in the indoor wireless network from another device, and granting or denying by the indoor network coordinator the participation based upon information related to the device having sent the request.

The method may further include establishing an outdoor wireless network among a plurality of outdoor units, and sending by one of the outdoor units the wireless signal to another outdoor unit. The method may also further include setting one outdoor unit present within the outdoor wireless network as an outdoor network coordinator. Here, the establishing of the outdoor wireless network may include searching for wireless channels by the outdoor network coordinator, designating by the outdoor network coordinator an optimum wireless channel among the wireless channels, receiving by the outdoor network coordinator a request for participation in the outdoor wireless network from an outdoor unit, the outdoor unit having not set to the outdoor network coordinator, and granting or denying by the outdoor network coordinator the participation based upon information related to the outdoor unit having sent the request.

The method may further include repeating by the outdoor unit, having not been set as the outdoor network coordinator, the wireless signal sent by the outdoor network coordinator.

In the air conditioning system and the communication method thereof, a wireless network may be established between the indoor unit and the controller or between the outdoor units to allow communications therebetween, thereby reducing installation and maintenance costs of a wired communication line, resulting in improving user's convenience. Also, the wireless network may be established between the indoor unit and the controller or between the outdoor units to allow communications therebetween, thereby facilitating device addition or device deletion, resulting in improving user's convenience and operation efficiency.

One or more outdoor units and a plurality of indoor units may be controlled without installation of a dedicated communication line or with less using the dedicated communication line, resulting in reduction of installation and operation costs.

The outdoor units or indoor units may perform communications using a plurality of communication technologies, such as wireless communication and pipe communication technologies and wireless communication and dedicated line communication technologies, and also perform communications with the controller using the wireless communication technology, resulting in improving system operation efficiency irrespective of installation environments and enhancing system stability.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 16 to 20A and 20B are flowcharts showing an exemplary communication method of an air conditioning system.

DETAILED DESCRIPTION OF THE INVENTION

Figure 1:
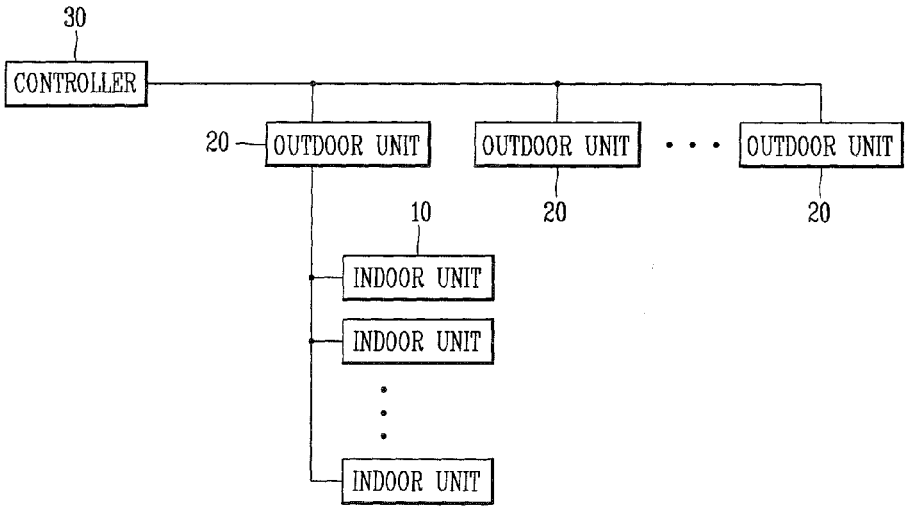
FIG. 1 is a block diagram schematically showing a constitution of a related art air conditioning system.

Description will now be given in detail of an air conditioning system and a communication method thereof according to the exemplary embodiments, with reference to the accompanying drawings. For the sake of brief description with reference to the drawings, the same or equivalent components will be provided with the same reference numbers, and description thereof will not be repeated.

Referring to FIGS. 2 to 5, an air conditioning system (air conditioner) may include a plurality of indoor units 100 for air conditioning, one or more outdoor units 200 linked to the indoor units 100 via a refrigerant pipe 500 for driving the indoor units 100, a controller 300 for controlling operations of the indoor units 100 and the outdoor units 200, and a communication unit 400 connected to part of the outdoor units 200 or indoor units 100 for performing communications among the indoor units 100, the outdoor units 200 and the controller 300 using a plurality of communication technologies.

The communication unit 400 may be connected to or provided at a part of outdoor units 200 or indoor units 100 to perform a wireless communication with the controller 300, and allow data communications between the outdoor unit 200 and the indoor unit 100 using one of pipe communication or dedicated line communication technology, not using wireless communication technology. The communication unit 400 may preferably be provided at the outdoor unit 200 or the indoor unit 100, which is the closest to the controller 300. For example, if the communication unit 400 is installed at the indoor unit 100 closest to the controller 300, when the controller 300 may send (originate) a control command, such as driving or stopping, cooling or heating, adjusting air flow and the like, to the indoor unit 100 using a wireless communication technology, the indoor unit 100 may operate in response to the control command. Alternatively, the controller 300 may send the control command to another indoor unit 100 without the communication unit 400. The controller 300 may send the control command to the indoor unit 100 having the communication unit 400 using a wireless communication technology, and then the indoor unit 100, which received the control command, transfers the control command to the corresponding indoor unit 100 using pipe communication or dedicated line communication technology other than the wireless communication technology.

Still referring to FIGS. 2 to 5, in the air conditioner, the communication unit 400 may include a first wireless communication module 410 for performing communications between the outdoor unit 200 or the indoor unit 100 and the controller 300 using wireless communication technologies. The communication unit 400 may further include a pipe communication module 430 for performing communications between the outdoor unit 200 and the indoor unit 100 using pipe communication technology.

The communication unit 400 may further include a signal converting module 420 for converting a wireless signal according to wireless communication technology into a pipe communication signal according to pipe communication technology or converting the pipe communication signal into the wireless signal.

Figure 2:
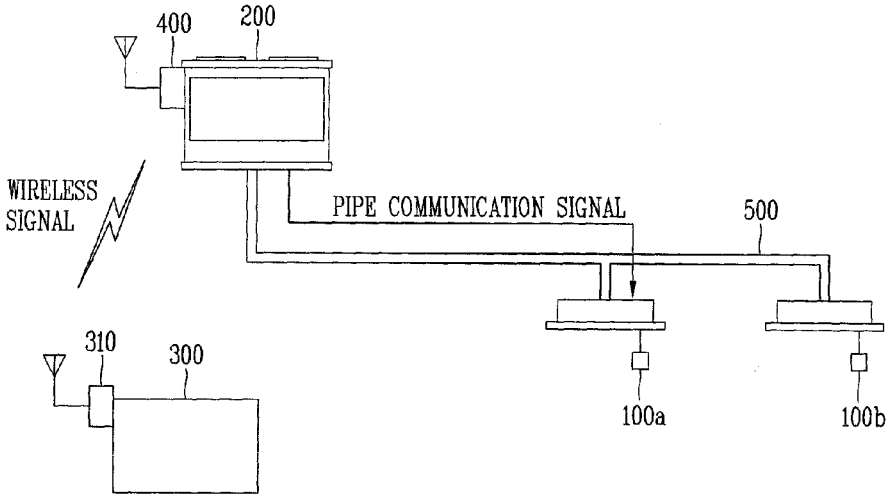
FIGS. 2 to 4 are schematic views showing an exemplary embodiment of an air conditioning system.

Referring to FIG. 2, the indoor units 100*a* and 100*b* may be connected to one outdoor unit 200, and the outdoor unit 200 may be equipped with the communication unit 400. Also, the controller 300 may include a second wireless communication module 310. Here, the controller 300 may send a control command to the outdoor unit 200 using the wireless communication technology, and the outdoor unit 200 may convert the control command into a pipe communication signal to transfer the pipe communication signal corresponding to the control command to an indoor unit 100 indicated by the received control command.

Figure 3:
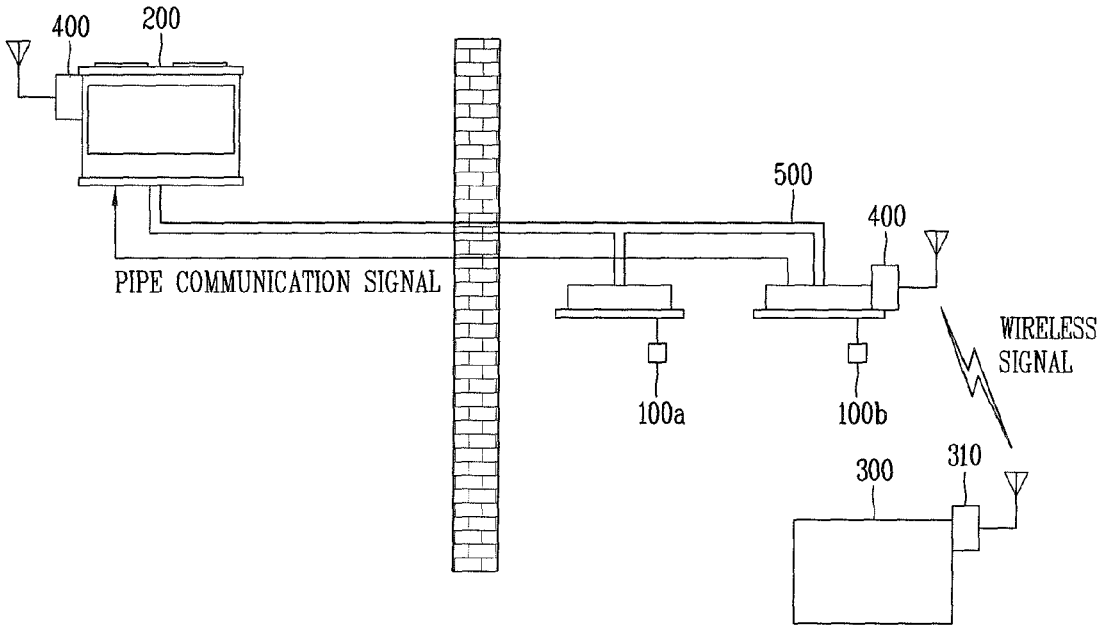

Referring to FIG. 3, two indoor units 100*a* and 100*b* may be connected to one outdoor unit 200 with a wall or floor interposed therebetween, and the controller 300 may be installed within a room. The communication unit 400 may be preferably installed at the indoor unit 100*b* which is located closest to the controller 300. This may have an advantage in that signal attenuation due to travel distance may be reduced. For example, if the controller 300 tries to send a control command to the indoor unit 100*a*, the controller 300 may send the control command to the communication unit 400 equipped at the indoor unit 100*b* through the second wireless communication module 310 installed therein, and the communication unit 400 may then convert the received control command into a pipe communication signal. Accordingly, the indoor unit 100*b* may transfer the pipe communication signal to the corresponding indoor unit 100*a* using the pipe communication technology.

Figure 4:
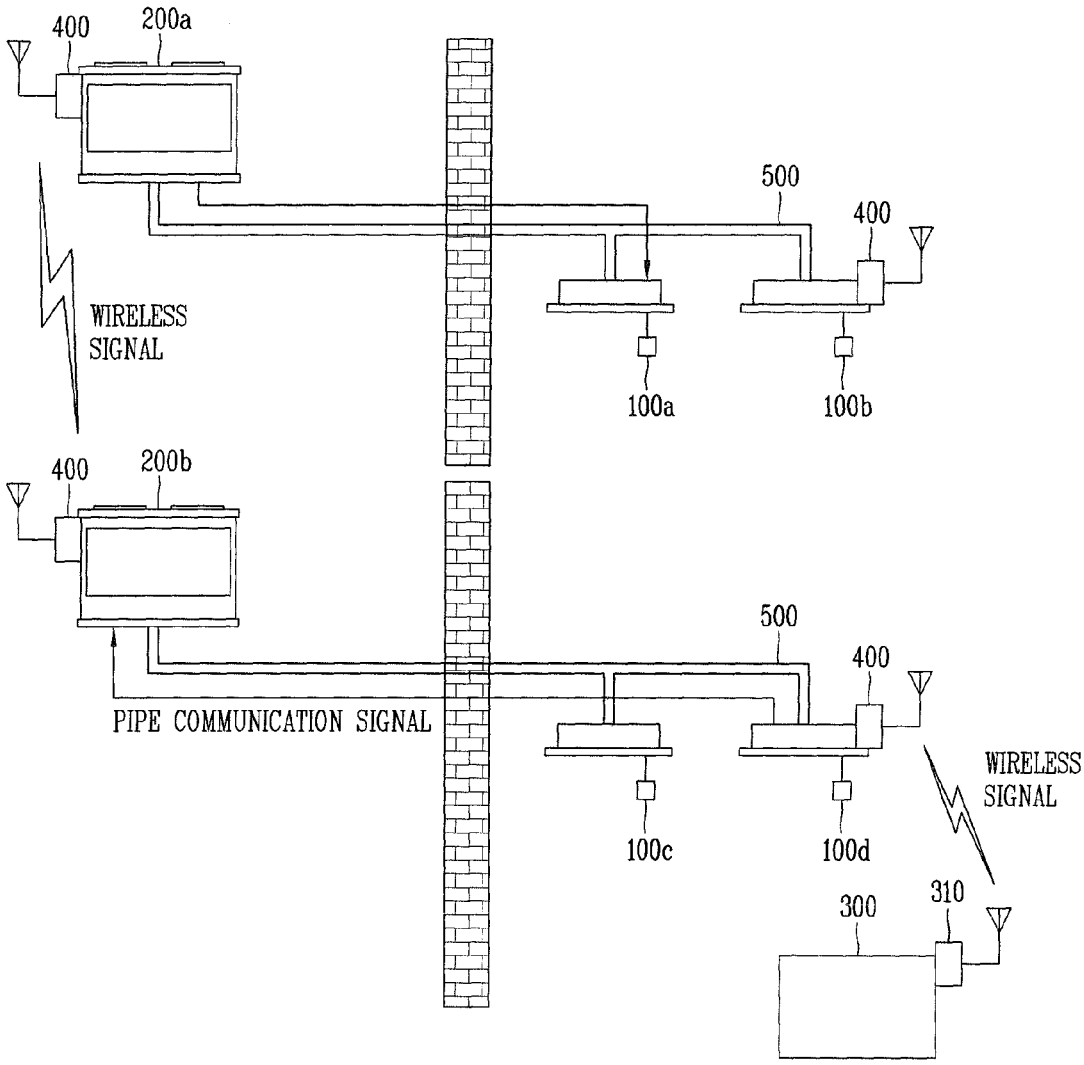

Referring to FIG. 4, two indoor units 100*a* and 100*b* and another two indoor units 100*c* and 100*d* may be connected to two outdoor units 200*a* and 200*b*, respectively, with a wall or floor interposed therebetween, and each of the outdoor units 200*a* and 200*b* may include the communication unit 400. The controller 300 may also include the second wireless communication module 310 and be present within a room. For example, if the controller 300 tries to send a control command to the indoor unit 100*a*, the controller 300 may convert the control command into a wireless signal to send to the closest indoor unit 100*d* using wireless communication technology. The communication unit 400, which received the wireless signal, may convert the wireless signal into a pipe communication signal, and the indoor unit 100*d* may transfer the pipe communication signal to the outdoor unit 200*b* connected thereto via the refrigerant pipe 500. Upon receiving the pipe communication signal, the outdoor unit 200*b* may convert it into a wireless signal to send to the outdoor unit 200*a*, to which the corresponding (target) indoor unit 100*a* is connected. The outdoor unit 200*a*, which received the wireless signal, may convert the wireless signal into the pipe communication signal so as to transfer to the corresponding indoor unit 100*a*.

Figure 5:
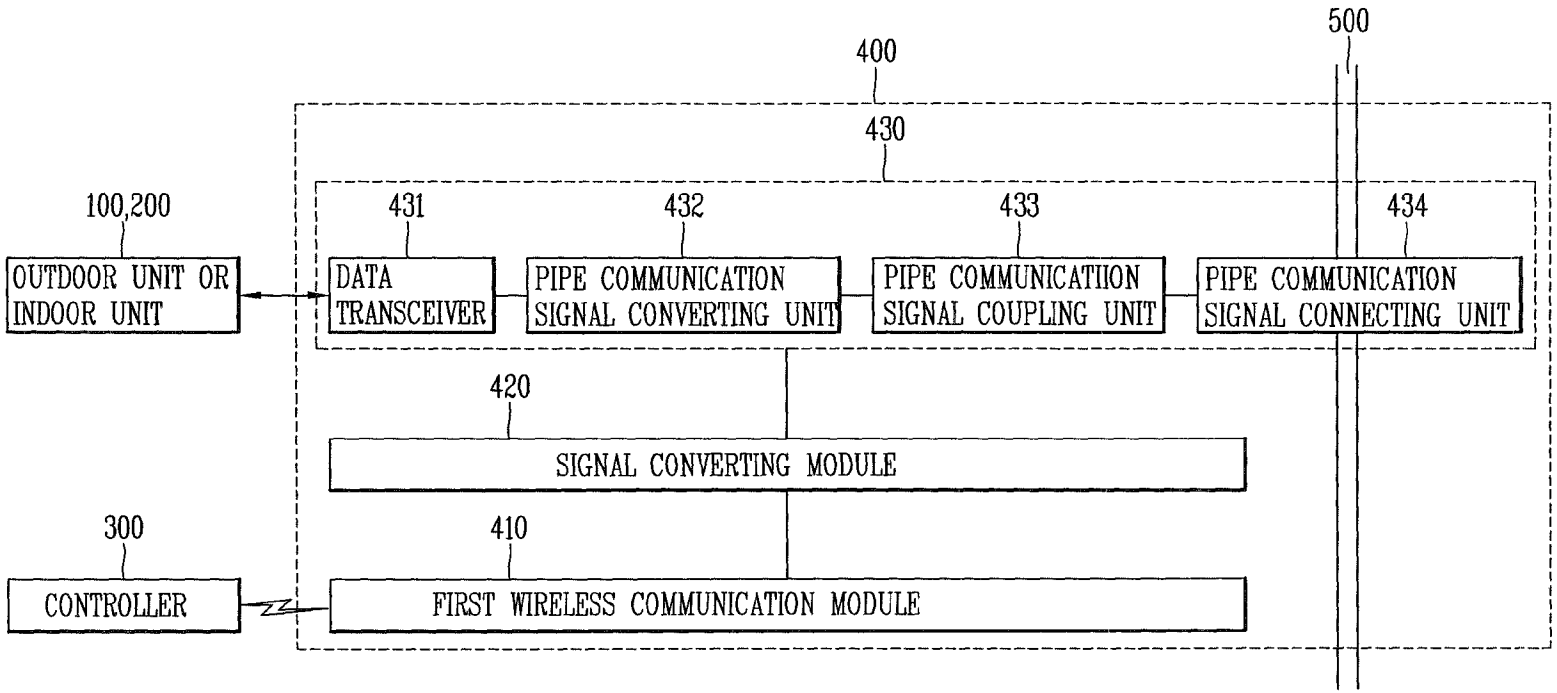
FIG. 5 is a block diagram showing an exemplary embodiment of a communication unit shown in FIGS. 2 to 4.

Referring to FIG. 5, in the air conditioner including the plurality of indoor units 100 for air conditioning, the one or more outdoor units 200 connected to the indoor units 100 via the refrigerant pipe 500 for operating the indoor units 100, and the controller 300 for controlling operations of the indoor units 100 and the outdoor units 200, the communication unit 400 may be connected to some of the outdoor units 200 or some of the indoor units 100 to allow communications between the outdoor unit 200 or the indoor unit 100 and the controller 300 using the wireless communication technology and communications between the indoor units 100 and the outdoor units 200 using the pipe communication technology.

The communication unit 400 may include a first wireless communication module 410 for allowing communications between the outdoor unit 200 or the indoor unit 100 and the controller 300 using wireless communication technology, a pipe communication module 430 for allowing communications between the outdoor unit 200 and the indoor unit 100 using pipe communication technology, and a signal converting module 420 for converting a wireless signal according to a wireless communication technology into a pipe communication signal according to a pipe communication technology or converting the pipe communication signal into a wireless signal.

The first wireless communication module 410 may receive an operation command or control data of an outdoor unit 200 or indoor unit 100 from the controller 300, and transfer data related to the outdoor unit 200 or indoor unit 100 to the controller 300. The first wireless communication module 410 may employ any wireless communication technology which is typically used, examples of which may include a wireless local area network (LAN), radio frequency (RF) communication, Bluetooth™, or infrared data association (IrDA).

The pipe communication module 430 may include a data transceiver 431 for receiving data from the outdoor unit 200 or indoor unit 100 and sending the data to the outdoor unit 200 or indoor unit 100, and a pipe communication signal converting unit 432 for converting the data into the pipe communication signal or the pipe communication signal into the data. A carrier frequency of the pipe communication signal may be set in consideration of the characteristic of the refrigerant pipe 500 used as a transmission medium. That is, a frequency signal may be connected to the refrigerant pipe 500 and a frequency band for enhancing communication reliability by reducing signal attenuation and interference with external noise may be used. The data transceiver 431 may receive data, such as operation (driving) data or the like, from the outdoor unit 200 or indoor unit 100 to transfer to the pipe communication signal converting unit 432. The pipe communication signal converting unit 432 may then convert the data into the pipe communication signal so as to send to another outdoor unit or indoor unit via the refrigerant pipe 500.

The pipe communication module 430 may further include a pipe communication signal connecting unit 434 for connecting the pipe communication signal to the refrigerant pipe 500. The pipe communication signal connecting unit 434 may include a magnetic core, which may generate a predetermined inductance with respect to the pipe communication signal, thereby enhancing communication reliability.

The pipe communication module 430 may further include a pipe communication signal coupling unit 433 disposed between the pipe communication signal converting unit 432 and the pipe communication signal connecting unit 434 for filtering the pipe communication signal and blocking noise and surge. The pipe communication signal coupling unit 433 may be provided with an inductor and a capacitor to filter a signal in a non-isolated manner, or provided with a transformer to block external noise and surge in a transformer-isolated manner.

The signal converting module 420 may convert a wireless signal according to wireless communication technology into a pipe communication signal or the pipe communication signal into a wireless signal. The signal converting module 420 may be included in the first wireless communication module 410 or the pipe communication module 430.

Figure 6:
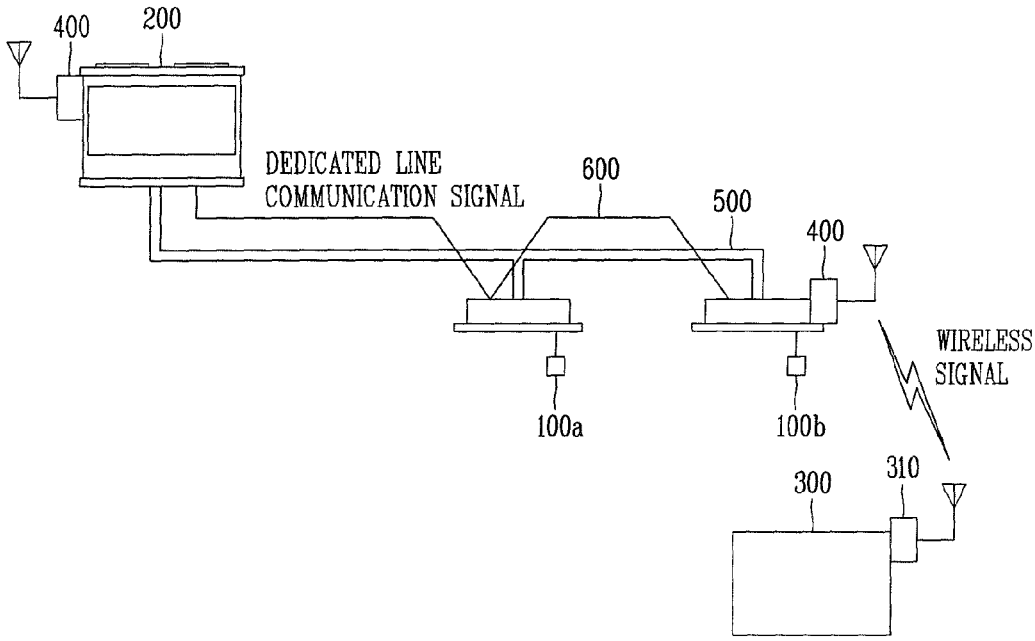
FIGS. 6 and 7 are schematic views showing an exemplary embodiments of an air conditioning system.
Figure 7:
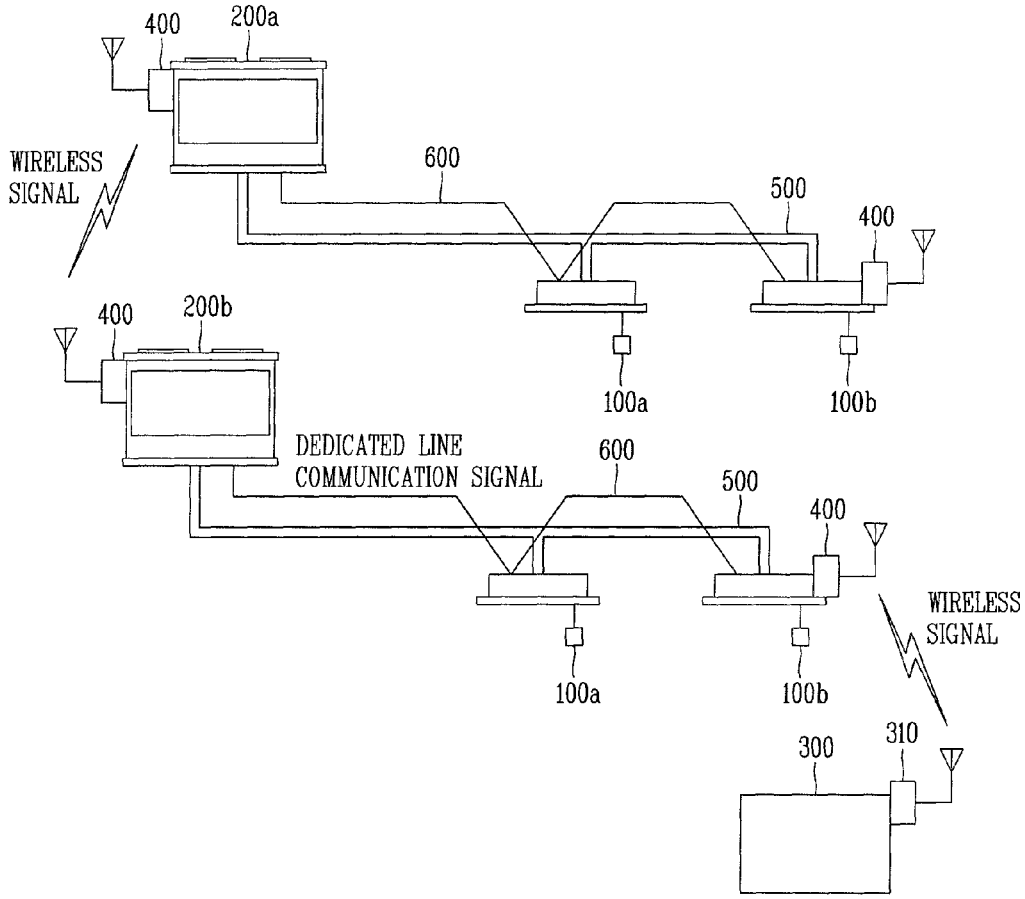
Figure 8:
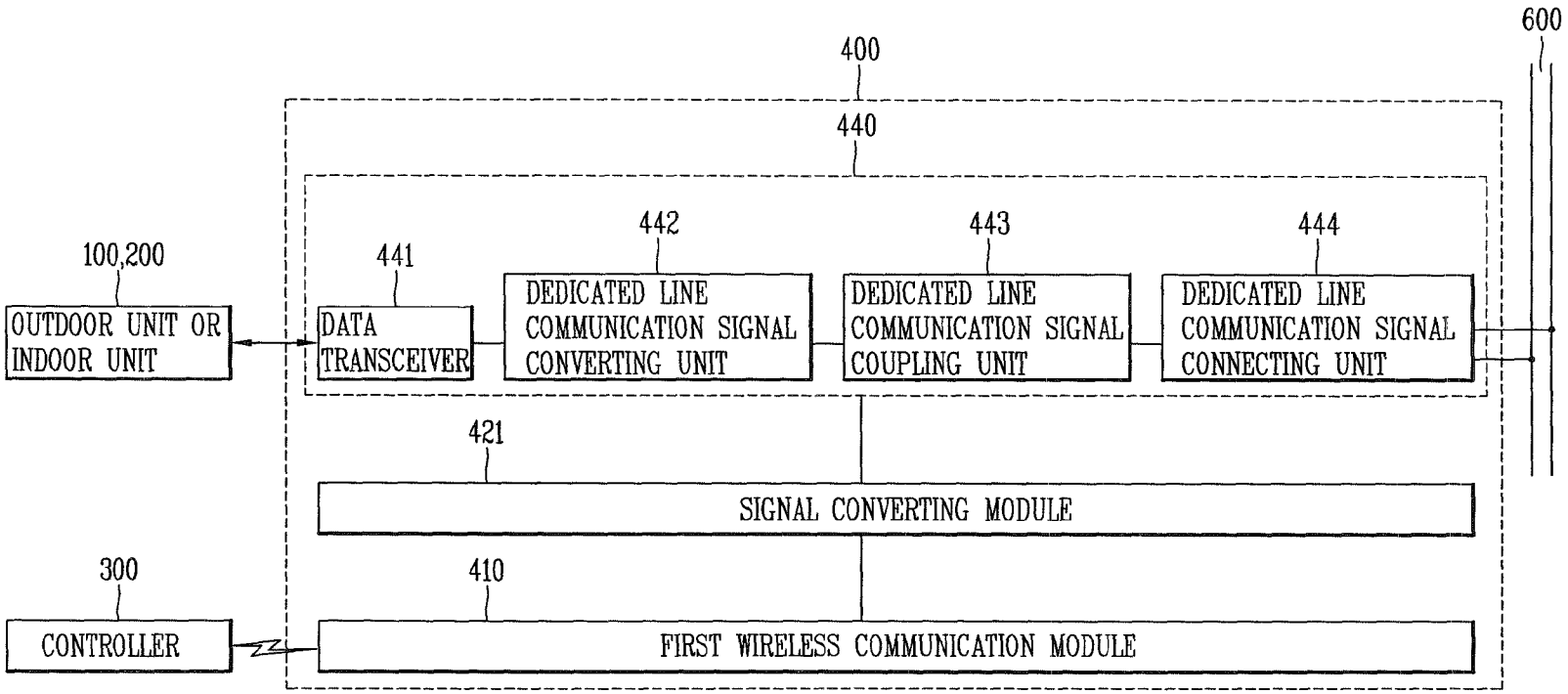
FIG. 8 is a block diagram showing an exemplary embodiment of a communication unit shown in FIGS. 6 and 7.

Referring to FIGS. 6 to 8, the communication unit 400 may include a wireless communication module 410 for allowing communications between the outdoor unit 200 or indoor unit 100 and the controller using the wireless communication technology, and a dedicated line communication module 440 for allowing communications between the outdoor unit 200 and the indoor unit 100 using a dedicated line communication technology.

The communication unit 400 may further include a signal converting module 421 for converting a wireless signal according to wireless communication technology into a dedicated line communication signal according to dedicated line communication technology, or a dedicated line communication signal into a wireless signal.

Here, examples of the dedicated line communication technologies may include serial communication, parallel communication, LAN communication, or RS-485 communication technology.

Referring to FIG. 6, two indoor units 100*a* and 100*b* may be connected to one outdoor unit 200 via a refrigerant pipe 500, and the outdoor unit 200 and the indoor units 100*a* and 100*b* may exchange data via a dedicated line 600. The controller 300 may include a second wireless communication module 310 and be installed adjacent to the indoor unit 100*b*. For example, if the controller 300 tries to send a control command to the indoor unit 100*a*, the controller 300 may convert the control command into a wireless signal to send to the indoor unit 100*b* via the second wireless communication module 310. The communication unit 400 installed in the indoor unit 100*b* may then convert the wireless signal into a dedicated line communication signal. The indoor unit 100*b* may transfer a dedicated line communication signal to a corresponding (target) indoor unit 100*a*.

Referring to FIG. 7, two indoor units 100*a* and 100*b* and another two indoor units 100*c* and 100*d* may be connected to two outdoor units 200*a* and 200*b*, respectively, and each of the outdoor units 200*a* and 200*b* may include a communication unit 400. The controller 300 may include a second wireless communication module 310 and be installed within a room. For example, if the controller 300 tries to send a control command to the indoor unit 100*a*, the controller 300 may convert the control command into a wireless signal to send to the closest indoor unit 100*d* using a wireless communication technology. Upon receiving the wireless signal, the communication unit 400 may convert the wireless signal into a dedicated line communication signal. The indoor unit 100*d* may then transfer the dedicated line communication signal to outdoor unit 200*b* connected thereto via a dedicated line 600. The outdoor unit 200*b*, which received the dedicated line communication signal, may convert the dedicated line communication signal back into a wireless signal to send to the outdoor unit 200*a*, to which the corresponding (target) indoor unit 100*a* may be connected. The outdoor unit 200*a*, which received the wireless signal, then may convert the wireless signal into a dedicated line communication signal so as to send to the corresponding indoor unit 100*a*.

Referring to FIG. 8, in the air conditioner including the plurality of indoor units 100 for air conditioning, one or more outdoor units 200 connected to the indoor units 100 via the refrigerant pipe 500 for driving the indoor units 100, and the controller 300 for controlling operations of the indoor units 100 and the outdoor units 200, the communication unit 400 may be connected to some of the outdoor units 200 or some of the indoor units 100 so as to allow communications between the outdoor unit 200 or indoor unit 100 and the controller 300 using a wireless communication technology and allow communications between the indoor unit 100 and the outdoor unit 200 using a dedicated line communication technology.

The communication unit 400 may include a first wireless communication module 410 for allowing communications between the outdoor unit 200 or indoor unit 100 and the controller according to the wireless communication technology, a dedicated line communication module 440 for allowing communications between the outdoor unit 200 and the indoor unit 100 by the dedicated line communication technology, and a signal converting module 421 for converting a wireless signal according to a wireless communication technology into a dedicated line communication signal according to a dedicated line communication technology or converting a dedicated line communication signal into a wireless signal.

The first wireless communication module 410 may receive an operation command or control data of the outdoor unit 200 or indoor unit 100 from the controller 300, and transfer data related to the outdoor unit 200 or indoor unit 100 to the controller 300. The first wireless communication module 410 may employ any wireless communication technology which is typically used, examples of which may include a wireless LAN, RF communication, Bluetooth™, or IrDA.

A dedicated line communication module 440 may include a data transceiver 441 for receiving data from the outdoor unit 200 or indoor unit 100 and sending the data to the outdoor unit 200 or indoor unit 100, and a dedicated line communication signal converting unit 442 for converting the data into a dedicated line communication signal or converting a dedicated line communication signal into data. Also, a dedicated line communication module 440 may further include a dedicated line communication signal connecting unit 444 for connecting a dedicated line communication signal to the dedicated line. The dedicated line communication module 440 may further include a dedicated line communication signal coupling unit 443 disposed between a dedicated line communication signal converting unit 442 and a dedicated line communication signal connecting unit 444 for filtering a dedicated line communication signal.

A data transceiver 441 may receive data from an outdoor unit 200 or indoor unit 100 to transfer to a dedicated line communication signal converting unit 442 or transfer data received from a dedicated line communication signal converting unit 442 to an outdoor unit 200 or indoor unit 100. The dedicated line communication signal converting unit 442 may convert data into a dedicated line communication signal or convert a dedicated line communication signal into data to transfer to a data transceiver 441. The dedicated line communication signal connecting unit 444 may include a matching unit for coupling the dedicated line communication signal to a dedicated line. A dedicated line communication signal coupling unit 443 may block affection of external noise or surge and filter the dedicated line communication signal.

A signal converting module 421 may convert a wireless signal according to wireless communication technology into a dedicated line communication signal, or convert a dedicated line communication signal into a wireless signal. The signal converting module 421 may be included in the wireless communication module 410 or the dedicated line communication module 440.

Referring to FIGS. 9 to 15, an air conditioning system (air conditioner) may include a plurality of indoor units 100 for air conditioning, one or more outdoor units 200 connected to part or all of the indoor units 100 via a refrigerant pipe 500 for driving the indoor units 100, one or more controllers 300 for establishing an indoor wireless network with part of the indoor units 100 and controlling operations of the indoor units 100 and the outdoor units 200 via the indoor wireless network, and a communication unit 400 connected to or equipped at the outdoor unit 200 or the indoor unit 100 for allowing communications of the indoor units 100, the outdoor units 200 and the controllers 300 using a plurality of communication technologies.

The communication unit 400 may be connected to some of the outdoor units 200 or some of the indoor units 100 so as to perform wireless communication with the controller 300, and allow data exchange between the outdoor unit 200 and the indoor unit 100 using a pipe communication or dedicated line communication technology. The communication unit 400 is understood by the foregoing description with reference to FIG. 5 or 8, so detailed description thereof is omitted.

Figure 9:
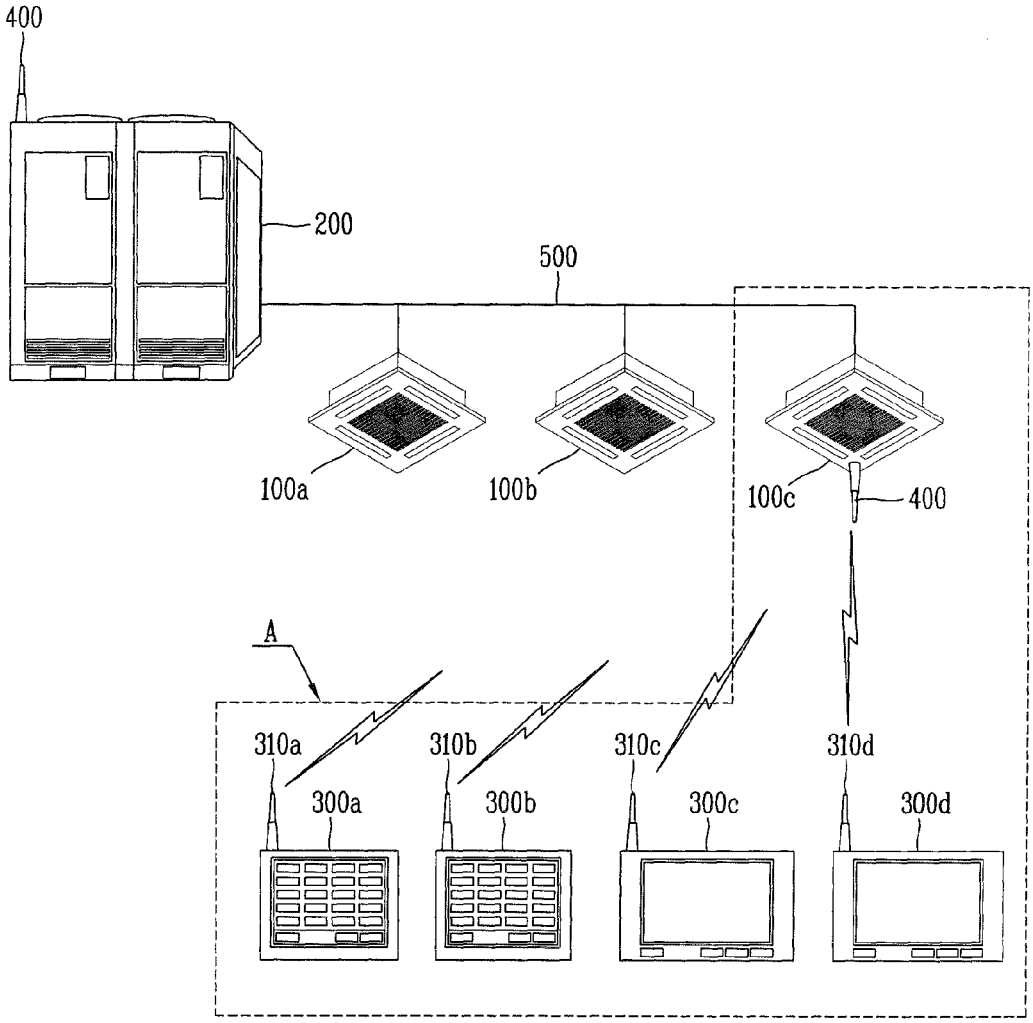
FIG. 9 is a view showing an exemplary operation of performing communications by establishing an indoor wireless network between controllers and indoor units in the air conditioning system.
Figure 12:
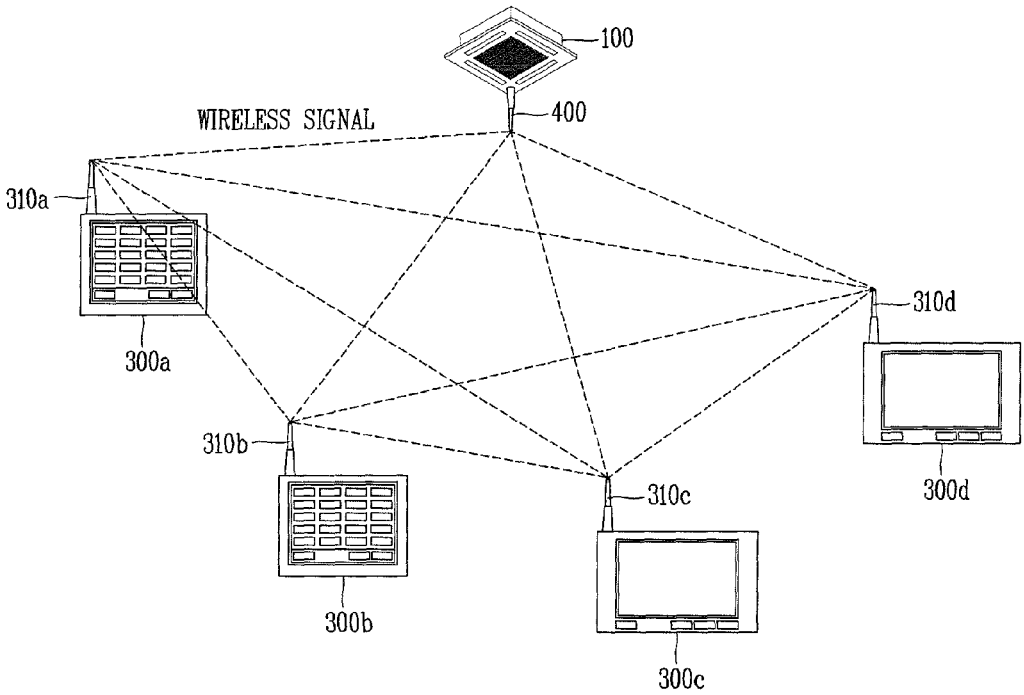
FIG. 12 is a view showing an exemplary operation of performing communications via an indoor wireless network in the air conditioning system.

FIG. 9 shows an air conditioner which includes a plurality of controllers 300*a* to 300*d* installed within rooms and performing wireless communications with the closest indoor unit 100*c*. Referring to FIG. 9, the plurality of controllers 300*a* to 300*d* and the closest indoor unit 100*c* may establish an indoor wireless network 'A' therebetween. The air conditioner may further include an indoor network coordinator disposed within the indoor wireless network. In general, the controller 300 may serve as the indoor network coordinator. One of the plurality of controllers 300*a* to 300*d* may also serve as the indoor network coordinator. The indoor network coordinator may handle data transmission and reception on the indoor wireless network, to which it belongs, and grant or deny participation of another controller or another indoor unit in the indoor wireless network. Here, if a master controller is present in the plurality of controllers, the controller may serve as the indoor network coordinator. Referring to FIG. 12, within the indoor wireless network, the indoor network coordinator may be configured to simultaneously send the same signal or data to all the components constituting the indoor wireless network. The air conditioner may alternatively be configured such that a random component constituting the indoor wireless network may send data to other components at the same time.

Figure 10:
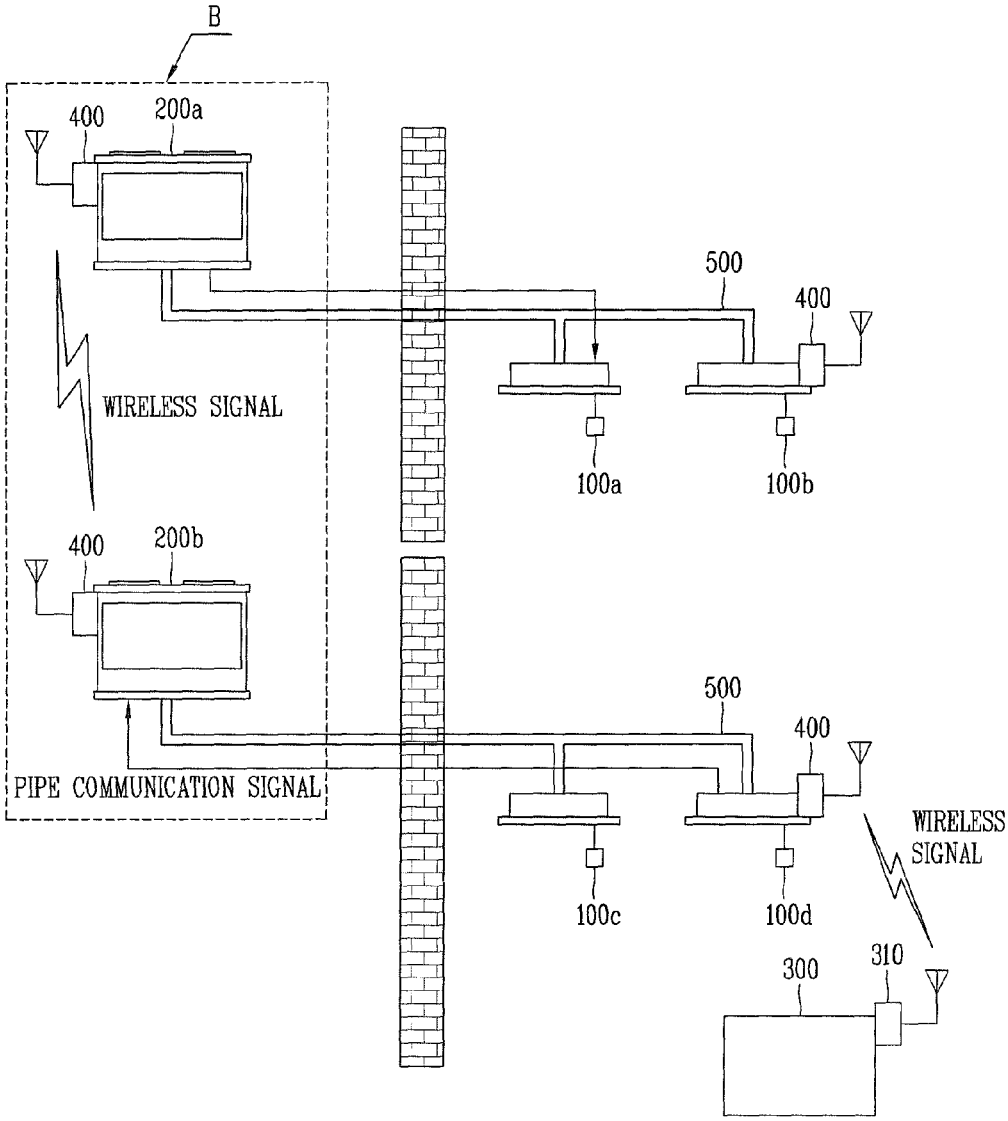
FIG. 10 is a view showing an exemplary operation of performing communications by establishing an outdoor wireless network among a plurality of outdoor units in the air conditioning system.

Referring to FIG. 10, two indoor units 100*a* and 100*b* and another two indoor units 100*c* and 100*d* may be connected to two outdoor units 200*a* and 200*b*, respectively, with a wall or floor interposed therebetween, and each of the outdoor units 200*a* and 200*b* may include a communication unit 400. The controller 300 may include a second communication module 310 and be installed within a room. For example, if the controller 300 tries to send a control command to the indoor unit 100*a*, the controller 300 may convert the control command into a wireless signal to send to the closest indoor unit 100*d* using a wireless communication technology. Upon receiving a wireless signal, the communication unit 400 of the indoor unit 100*d* may convert the wireless signal into a pipe communication signal. The indoor unit 100*d* may transfer the pipe communication signal to the outdoor unit 200*d*, to which the indoor unit 100*d* is connected via the refrigerant pipe 500. Upon receiving a pipe communication signal, the outdoor unit 200*b* may convert the pipe communication signal back into a wireless signal, to send to the outdoor unit 200*a*, to which the corresponding (target) indoor unit 100*a* may be connected. After receiving a wireless signal, the outdoor unit 200*a* may convert the wireless signal into a pipe communication signal to send to the corresponding indoor unit 100*a*. Here, the outdoor units 200*a* and 200*b* establish an outdoor wireless network 'B.' Here, the air conditioner may further include an outdoor network coordinator disposed within the outdoor wireless network B for allowing communications within the outdoor wireless network and granting or denying participation of another component in the outdoor wireless network B. The outdoor network coordinator may handle transmission and reception of data or signals between the outdoor units, and control participation or non-participation of another outdoor unit in the outdoor wireless network B. Here, the outdoor network coordinator may be an outdoor unit adjacent to the controller 300.

Figure 11:
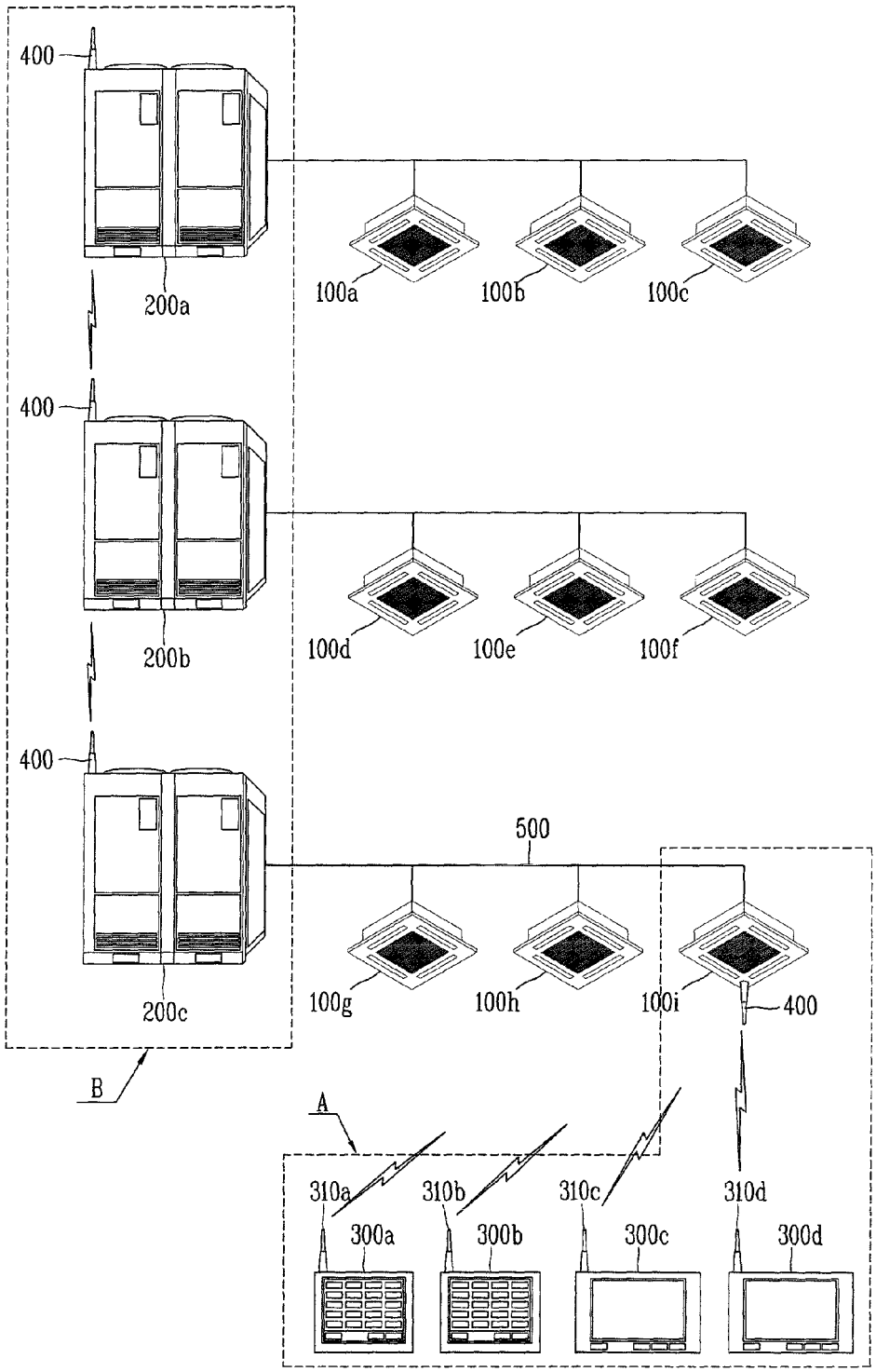
FIG. 11 is a view showing an exemplary operation of performing communications by respectively establishing an indoor wireless network between the controllers and the indoor units and an outdoor wireless network among the plurality of outdoor units in the air conditioning system.

Referring to FIG. 11, in the air conditioner, the indoor wireless network A may be established between the plurality of controllers 300*a* to 300*d* and the indoor unit 100*i*, and the outdoor wireless network B may be established among the plurality of outdoor units 200*a* to 200*c*. Here, one of the plurality of controllers 300*a* to 300*d*, for example, a master controller may be the indoor network coordinator, and the outdoor unit 200*c*, which may be connected to the indoor unit 100*i* establishing the indoor wireless network A via the refrigerant pipe 500, may serve as the outdoor network coordinator.

Figure 13:
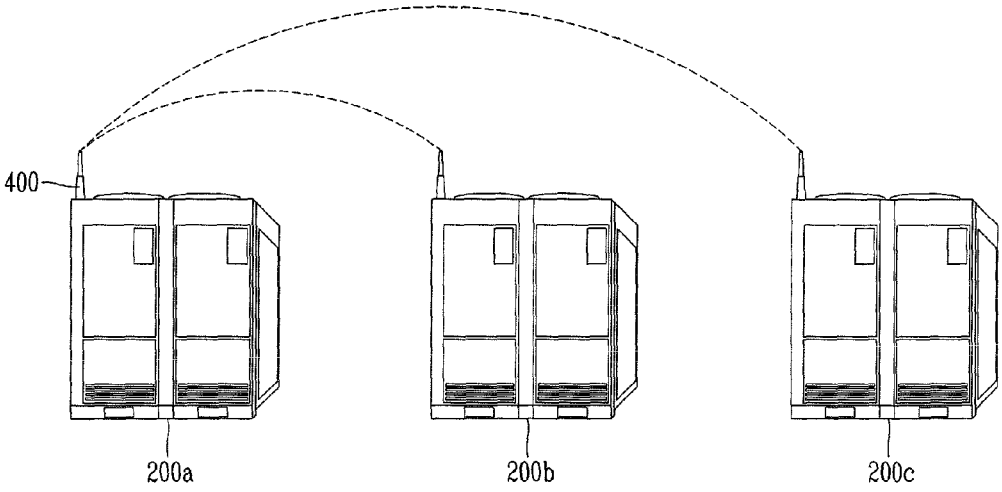
FIGS. 13 and 14 are views each showing an exemplary operation of performing communications via an outdoor wireless network in the air conditioning system.
Figure 14:
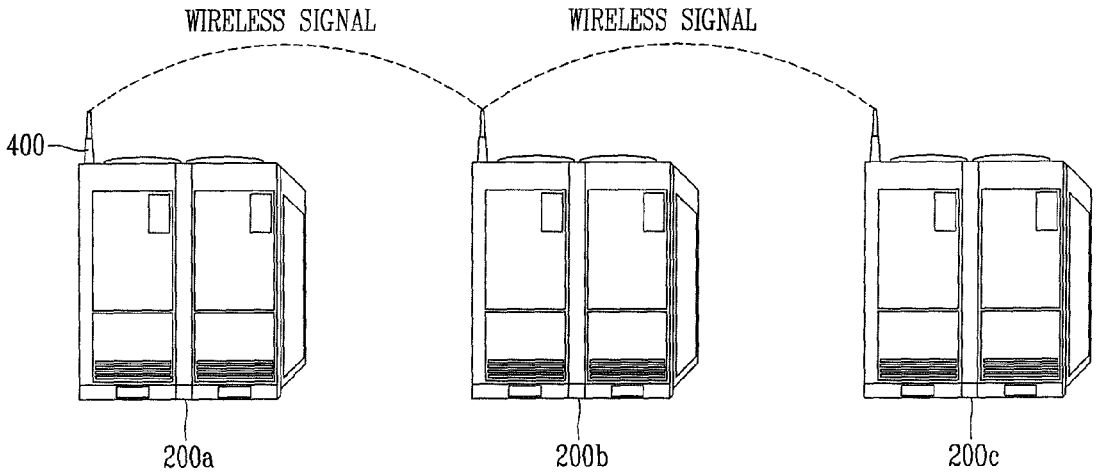

FIG. 13 shows that three outdoor units 200*a* to 200*c* establish an outdoor wireless network, in which the outdoor unit 200*a* serves as the outdoor network coordinator. Here, the outdoor network coordinator 200*a* exchanges data with the other outdoor units 200*b* and 200*c*. FIG. 14 shows an example of including a repeating unit for receiving and reproducing a signal sent by the outdoor network coordinator and transferring the reproduced signal to another outdoor unit. That is, the three outdoor units 200*a* to 200*c* establish the outdoor wireless network and the outdoor unit 200*a* may be set as the outdoor network coordinator. However, if a certain outdoor unit 200*c* is farther away from the outdoor network coordinator or direct communication is disabled due to an obstacle or the like, the repeating unit is used to receive a signal or data from the outdoor network coordinator and reproduce the signal or data to send to the corresponding outdoor unit. Here, the repeating unit may be the outdoor unit itself within the outdoor wireless network or equipped in or connected to the outdoor unit in form of a repeater.

Figure 15:
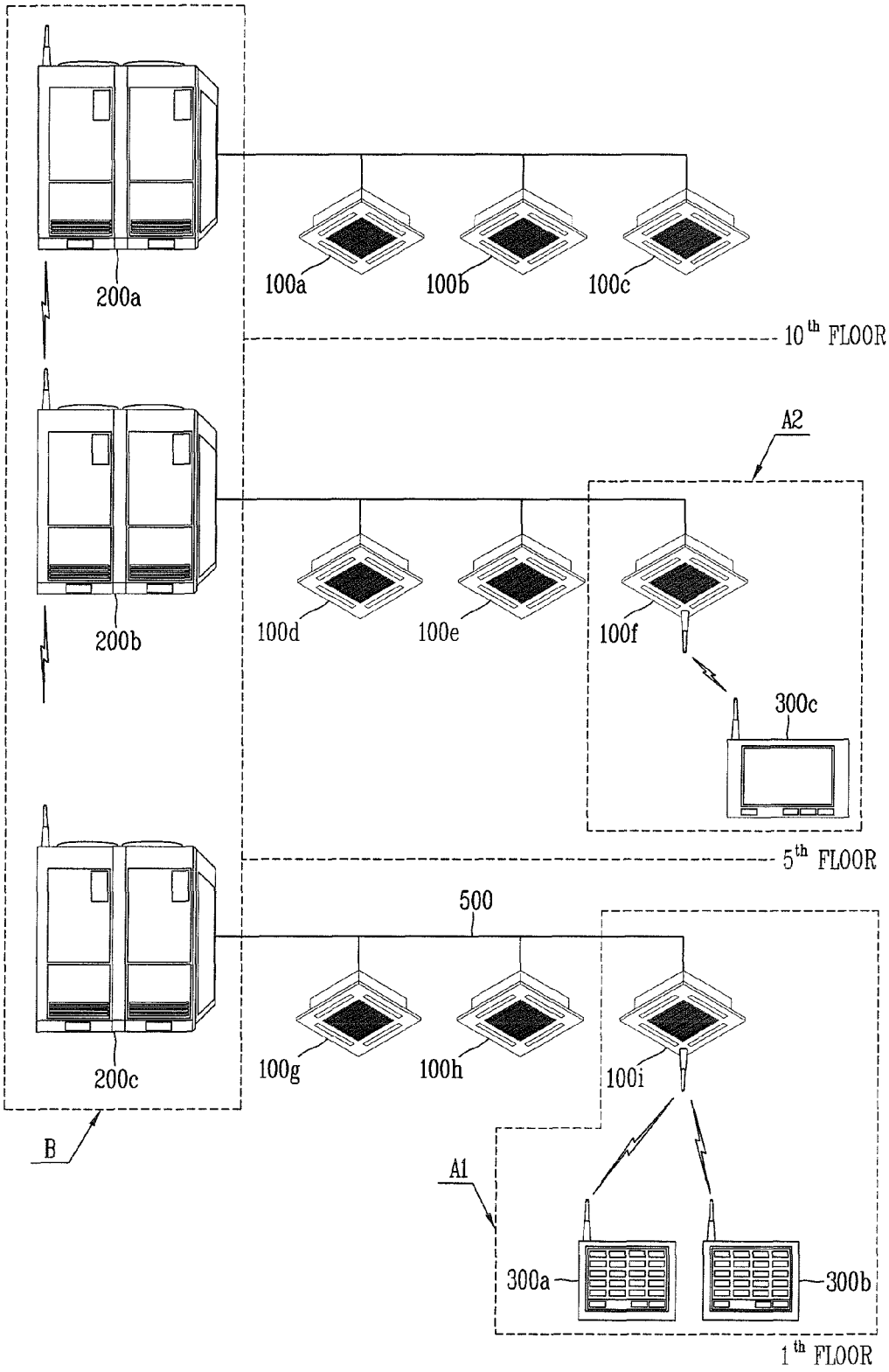
FIG. 15 is a view showing an exemplary operation of establishing a plurality of indoor wireless networks in the air conditioning system.

Referring to FIG. 15, a plurality of controllers 300*a* to 300*c* may be provided and each controller may be installed in a different floor, for example, first floor or fifth floor. In this case, each of the controllers 300*a* to 300*c* may establish an indoor wireless network with an adjacent indoor unit. That is, the controllers 300*a* to 300*c* may establish the indoor wireless networks with part of the indoor units, respectively, and each indoor wireless network may have an indoor network coordinator. Each of the controllers 300*a* and 300*b* may have a communication unit and establish an indoor wireless network A1 with the adjacent indoor unit 100*i*, and the controller 300*c* may also have the communication unit, and establishes another indoor wireless network A2 with the adjacent indoor unit 100*f*.

Figure 16:
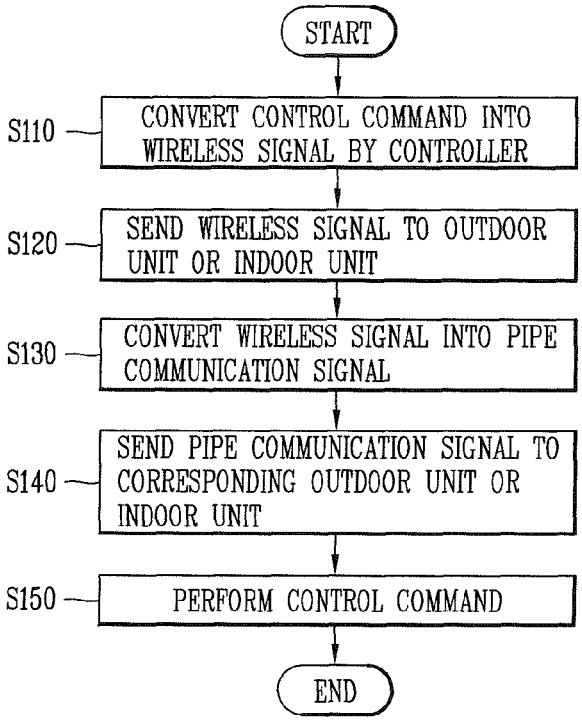

Referring to FIG. 16, a communication method for an air conditioner, including a plurality of indoor units for air conditioning, one or more outdoor units connected to the indoor units via a refrigerant pipe for driving the indoor units, and a controller for controlling operations of the indoor units and the outdoor units, may include converting by the controller a control command into a wireless signal (S110), transmitting the wireless signal from the controller to the outdoor unit or the indoor unit (S120), converting by the outdoor unit or the indoor unit the wireless signal into a pipe communication signal (S130), and sending by the outdoor unit or the indoor unit the pipe communication signal to an outdoor unit or indoor unit as a target of the control command (S140). The corresponding outdoor unit or indoor unit receiving the control command operates based upon the control command. Here, as a wireless communication technology, one or more of general wireless communication technologies, such as wireless LAN, RF communication, Bluetooth™, or IrDA, may be used. The constitution of the apparatus will be understood with reference to FIGS. 2 to 5.

Referring to FIG. 2, two indoor units 100*a* and 100*b* may be connected to one outdoor unit 200 and the outdoor unit 200 may be provided with the communication unit 400. Also, the controller 300 may include a second wireless communication unit 310. Here, the second wireless communication unit 310 may convert the control command into a wireless signal (S110). The controller 300 may send the control command to the outdoor unit 200 using a wireless communication technology (S120). The outdoor unit 200 may convert the control command into a pipe communication signal (S130), and transfer the pipe communication signal corresponding to the control command to the indoor unit as the target of the received control command (S140).

Referring to FIG. 3, two indoor units 100*a* and 100*b* may be connected to one outdoor unit 200 with a wall or floor interposed therebetween, and the controller 300 may be installed within a room. The communication unit 400 is preferably installed at the indoor unit 100*b* closest to the controller 300. This has an advantage in that signal attenuation due to travel distance may be reduced and the controller 300 may be within a room. For example, if the controller 300 tries to send a control command to the indoor unit 100*a*, the controller 300 may convert the control command into a wireless signal to send to the communication unit 400 equipped at the indoor unit 100*b* through the wireless communication module 310 installed therein (S110, S120). The communication unit 400 may then convert the received wireless signal into a pipe communication signal (S130). Accordingly, the indoor unit 100*b* may transfer the pipe communication signal to a corresponding indoor unit 100*a* using pipe communication technology.

Referring to FIG. 4, two indoor units 100*a* and 100*b* and another two indoor units 100*c* and 100*d* may be connected to two outdoor units 200*a* and 200*b* with a wall or floor interposed therebetween, and each of the outdoor units 200*a* and 200*b* may include a communication unit 400. The controller 300 also may include a second wireless communication module 310 and be present within a room. For example, if the controller 300 tries to send a control command to the indoor unit 100*a*, the controller 300 may convert the control command into a wireless signal to send to the closest indoor unit 100*d* using wireless communication technology (S110 and S120). The communication unit 400, which received the wireless signal, may convert the wireless signal into a pipe communication signal (S130), and the indoor unit 100*d* may transfer the pipe communication signal to the outdoor unit 200*b* connected thereto via a refrigerant pipe (S140). Upon receiving the pipe communication signal, the outdoor unit 200*b* may convert it into a wireless signal to send to the outdoor unit 200*a*, to which the corresponding (target) indoor unit 100*a* may be connected. The outdoor unit 200*a*, which receives the wireless signal, may convert the wireless signal into a pipe communication signal so as to transfer to the corresponding indoor unit 100*a* (S140).

Figure 17:
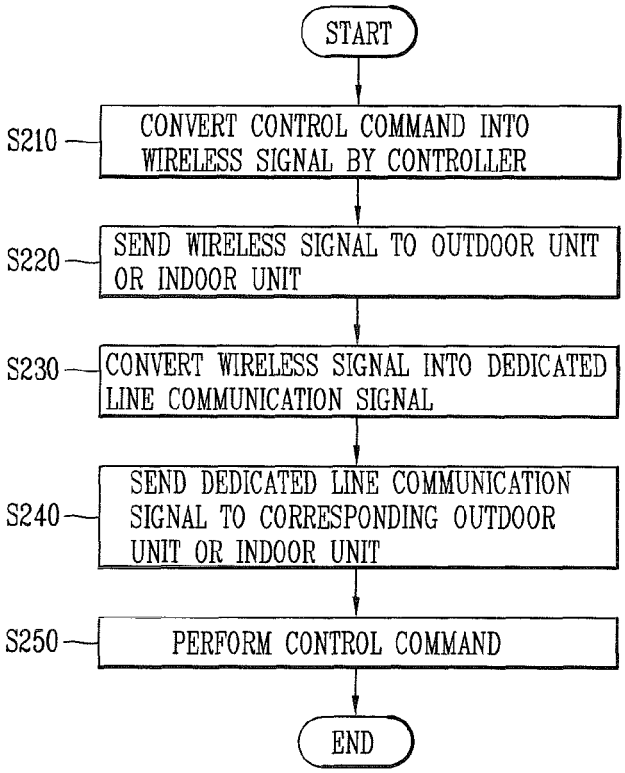

Referring to FIG. 17, a communication method for an air conditioner including a plurality of indoor units for air conditioning, one or more outdoor units connected to the indoor units via a refrigerant pipe for driving the indoor units, and a controller for controlling operations of the indoor units and the outdoor units, may include converting by the controller a control command into a wireless signal (S210), sending the wireless signal from the controller to the outdoor unit or the indoor unit (S220), converting by the outdoor unit or the indoor unit the wireless signal into a dedicated line communication signal (S230), and sending by the outdoor unit or the indoor unit the dedicated line communication signal to an outdoor unit or indoor unit as a target of the control command (S240). The corresponding outdoor unit or indoor unit receiving the control command performs the control command. Here, the constitution of the apparatus will be understood with reference to FIGS. 6 to 8. Here, as the wireless communication technology, one or more of general wireless communication technologies, such as wireless LAN, RF communication, Bluetooth™, or IrDA, may be used. Also, examples of the dedicated line communication technologies may include serial communication, parallel communication, LAN communication, or RS-485 communication technology.

Referring to FIG. 6, two indoor units 100*a* and 100*b* may be connected to one outdoor unit 200 via the refrigerant pipe 500, and the outdoor unit 200 and the indoor units 100*a* and 100*b* may exchange data via a dedicated line 600. The controller 300 may include the second wireless communication module 310 and be installed adjacent to the indoor unit 100*b*. For example, if the controller 300 tries to send a control command to the indoor unit 100*a*, the controller 300 may convert the control command into a wireless signal to send to the indoor unit 100*b* via a second wireless communication module 310 (S210 and S220). The communication unit 400 installed in the indoor unit 100*b* may then convert the wireless signal into a dedicated line communication signal (S230). The indoor unit 100*b* may transfer the dedicated line communication signal to a corresponding indoor unit 100*a* (S240).

Referring to FIG. 7, two indoor units 100*a* and 100*b* and another two indoor units 100*c* and 100*d* may be connected to two indoor units 200*a* and 200*b*, respectively, and each of the outdoor units 200*a* and 200*b* may include a communication unit 400. The controller 300 may include a second wireless communication module 310 and be installed within a room. For example, if the controller 300 tries to send a control command to the indoor unit 100*a*, the controller 300 may convert the control command into a wireless signal to send to the closest indoor unit 100*d* using wireless communication technology. Upon receiving the wireless signal, the communication unit 400 may convert the wireless signal into a dedicated line communication signal (S230). The indoor unit 100*d* may then transfer the dedicated line communication signal to the outdoor unit 200*b* via a dedicated line 600 (S240). The outdoor unit 200*b*, which received the dedicated line communication signal, may convert the dedicated line communication signal back into a wireless signal to send to the outdoor unit 200*a*, to which the corresponding (target) indoor unit 100*a* is connected. The outdoor unit 200*a*, which received the wireless signal, may convert the wireless signal into the dedicated line communication signal so as to send to the corresponding indoor unit 100*a* (S240).

Figure 18:
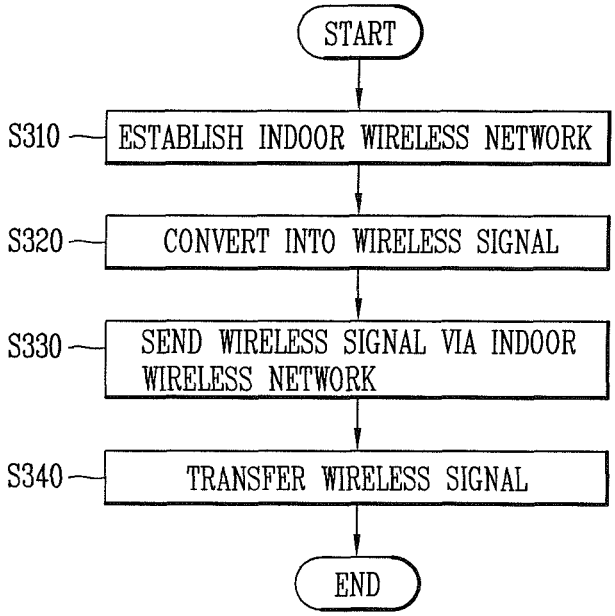

Referring to FIG. 18, a communication method for an air conditioner including a plurality of indoor units for air conditioning, one or more outdoor units connected to the indoor units via a refrigerant pipe for driving the indoor units, and a controller for controlling operations of the indoor units and the outdoor units, may include establishing an indoor wireless network between the controller and part of the indoor units (S310), converting by the controller a control command into a wireless signal (S320), sending by the controller the wireless signal to an indoor unit via the indoor wireless network (S330), and transferring by the indoor unit the received wireless signal to the outdoor unit or another indoor unit (S340). Here, the controller may be an indoor network coordinator. That is, the air conditioner may include an indoor network coordinator disposed within the indoor wireless network for performing communications within the indoor wireless network and granting or denying participation of other devices in the indoor wireless network. In general, a controller, for example, a master controller may serve as the indoor network coordinator. The indoor network coordinator may handle data transmission and reception in an indoor wireless network to which the indoor network coordinator belongs, and grant or deny participation of another device, for example, another controller or another indoor unit, in the indoor wireless network.

For example, referring to FIG. 9, a plurality of controllers 300*a* to 300*d* and an indoor unit 100*c* adjacent to them may establish an indoor wireless network A (S310). Here, one of the plurality of controllers may serve as the indoor network coordinator. If a master controller is present in the plurality of controllers, the corresponding controller may serve as the indoor network coordinator. Referring to FIG. 12, the indoor network coordinator within the indoor wireless network may be configured to simultaneously send the same signal or data to all the components constituting the indoor wireless network. The air conditioner may alternatively be configured such that a random component constituting the indoor wireless network can send data to other components at the same time.

Referring to FIG. 15, a plurality of controllers 300*a* to 300*c* may be provided and each controller may be installed in a different floor, for example, first floor, or fifth floor. In this case, each of the controllers 300*a* to 300*c* establishes an indoor wireless network with adjacent indoor units (S310). That is, the controllers 300*a* to 300*c* may establish an indoor wireless networks with some of the indoor units, respectively, and each indoor wireless network may have an indoor network coordinator. Each of the controllers 300*a* and 300*b* may have a communication unit and may establish an indoor wireless network A1 with the adjacent indoor unit 100*i*, and the controller 300*c* may also have a communication unit and establish another indoor wireless network A2 with the adjacent indoor unit 100*f* (S310).

Figure 19:
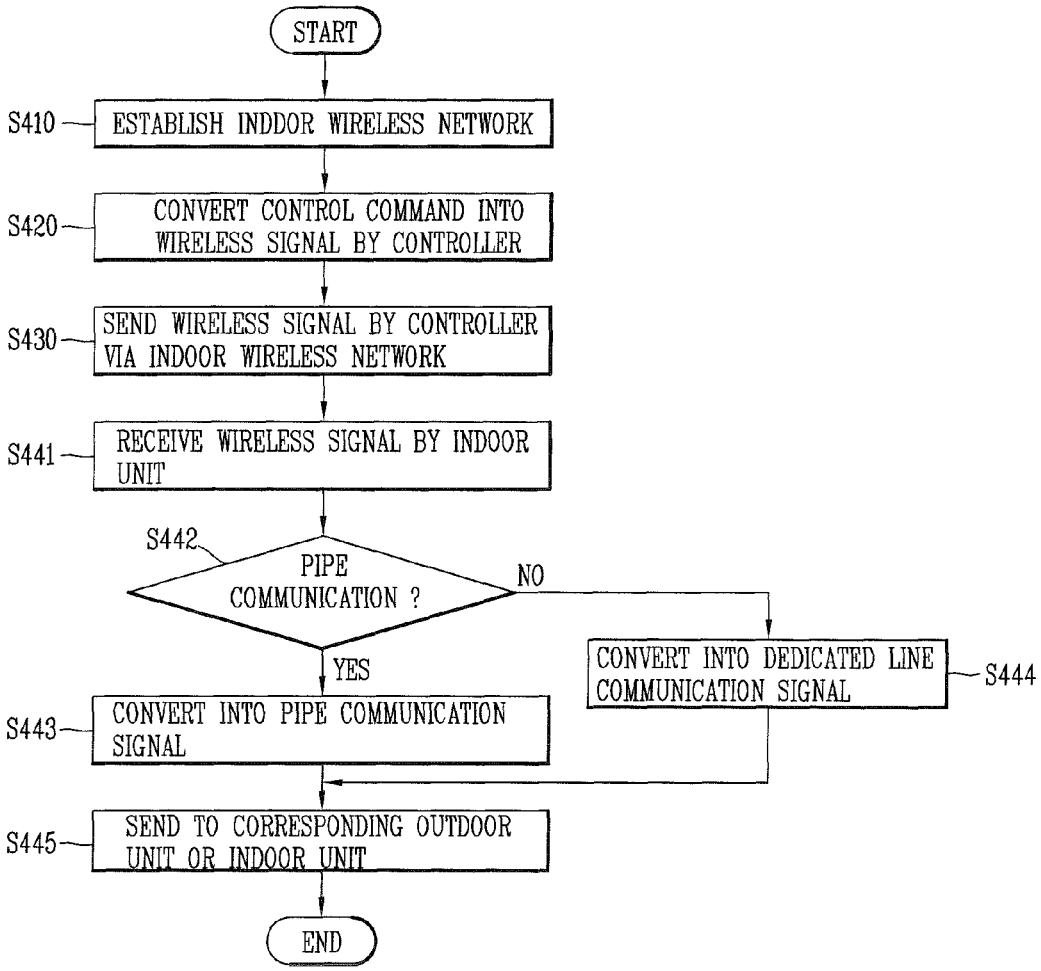

Referring to FIG. 19, a communication method for an air conditioner may include establishing an indoor wireless network between the controller and some of the indoor units (S410), converting by the controller a control command into a wireless signal (S420), sending by the controller the wireless signal to an indoor unit via the indoor wireless network (S430), and transferring by the indoor unit the received wireless signal to the outdoor unit or another indoor unit (S440), wherein the transferring of the wireless signal to the outdoor unit or another indoor unit may include converting by the indoor unit the received the wireless signal into a pipe communication signal (S443), and sending by the indoor unit, which received the wireless signal, the pipe communication signal to the outdoor unit or another indoor unit as a target of the control command (S445). Also, the sending of the pipe communication signal to the outdoor unit or another indoor unit may include converting by the indoor unit the received wireless signal into a dedicated line communication signal (S444), and sending by the indoor unit, which received the wireless signal, the dedicated line communication signal to the outdoor unit or another indoor unit as a target of the control command (S445).

Referring to FIG. 3, two indoor units 100*a*, 100*b* may be connected to one outdoor unit 200 with a wall or floor interposed therebetween, and the controller 300 may be installed within a room. The communication unit 400 is preferably installed in the indoor unit 100*b* which may be located closest to the controller 300. This has an advantage in that signal attenuation due to travel distance can be reduced and the controller 300 may be allowed to be within a room. Here, some of the indoor units 100*a* and 100*b* and the controller 300 may establish an indoor wireless network, and the controller 300 may serve as the indoor network coordinator. FIG. 9 shows an air conditioner which includes a plurality of controllers 300*a* to 300*d* installed within rooms and performing wireless communications with the closest indoor unit 100*c*. Referring to FIG. 9, the plurality of controllers 300*a* to 300*d* and the closest indoor unit 100*c* may establish an indoor wireless network A therebetween. If the controller 300 is installed outside or adjacent to the outdoor unit 200, the controller and the outdoor unit 200 may directly transmit and receive signals using a wireless communication technology.

For example, referring to FIG. 3, if the controller 300 tries to send a control command to the indoor unit 100*a*, the controller 300 may convert the control command into a wireless signal to send to the communication unit 400 equipped at the indoor unit 100*b* through the second wireless communication module 310 installed therein (S420 and 430), and the communication unit 400 then converts the received wireless signal into a pipe communication signal (or a dedicated line communication signal in FIGS. 6 to 8) (S443 and S445). Accordingly, the indoor unit 100*b* may transfer the pipe communication signal (or the dedicated line communication signal to the corresponding indoor unit 100*a* using the pipe communication technology (or the dedicated line communication technology) (S445). Here, as a wireless communication technology, one or more of general wireless communication technologies, such as wireless LAN, RF communication, Bluetooth™, IrDA and the like, may be used. Also, examples of the dedicated line communication technologies may include serial communication, parallel communication, LAN communication, or RS-485 communication technology.

Figure 20A:
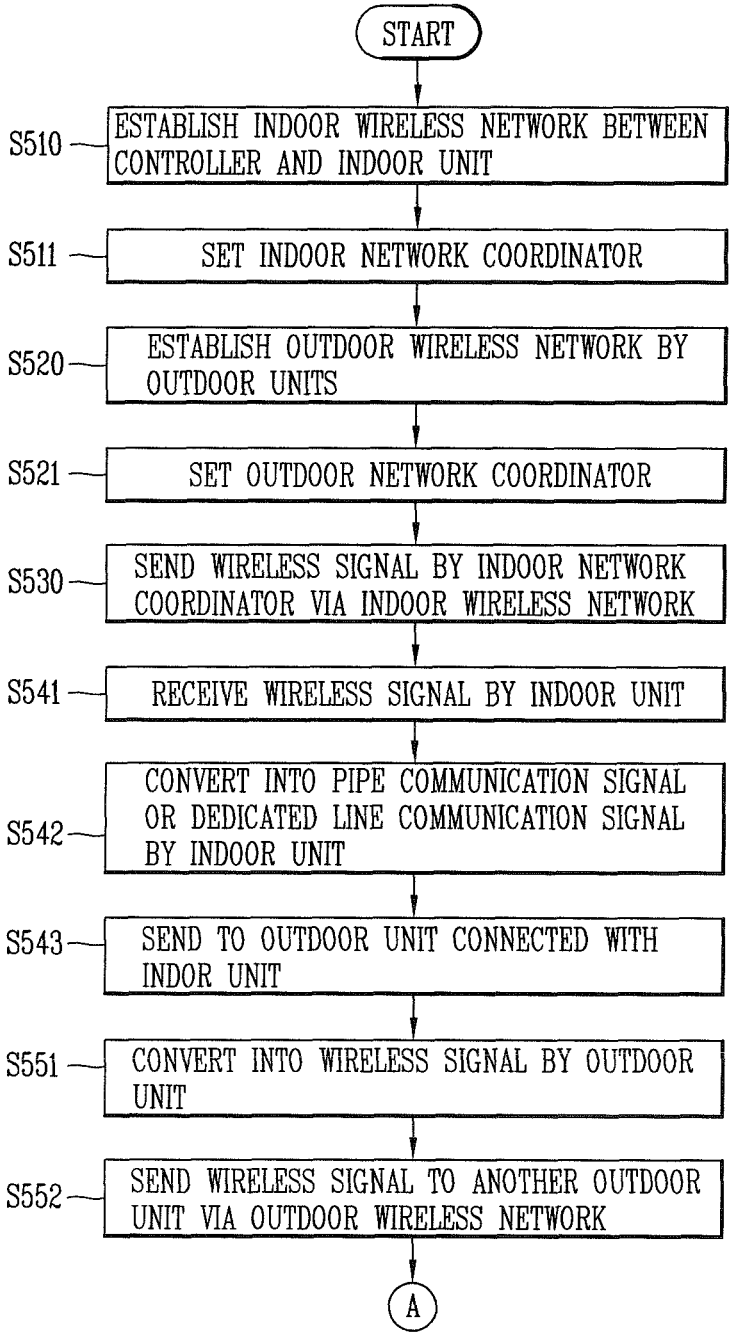
Figure 20B:
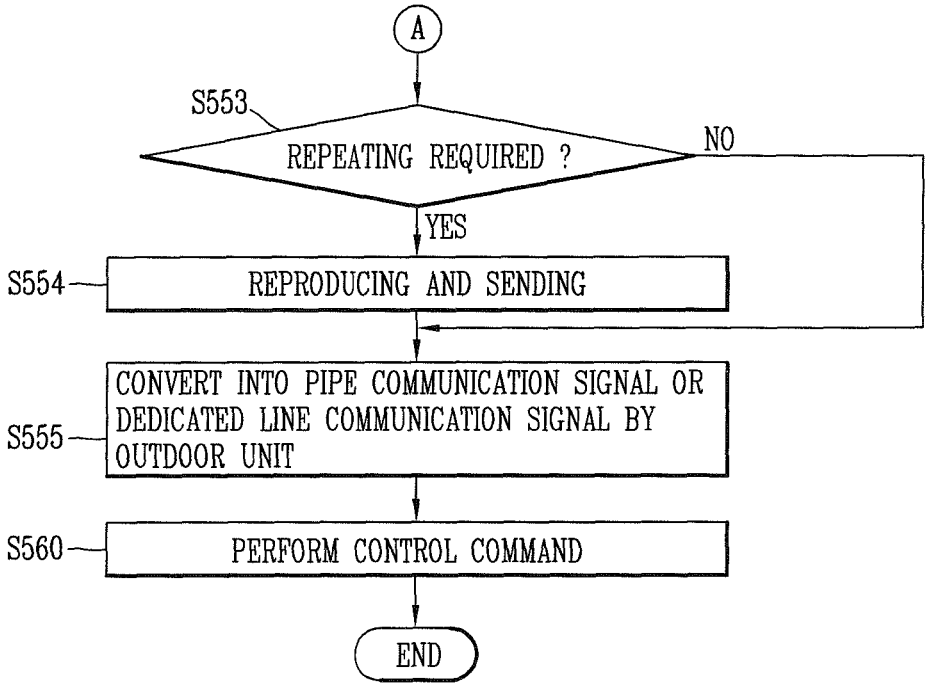

Referring to FIG. 20, a communication method for an air conditioner may include establishing an indoor wireless network between the controller and some of the indoor units (S510), setting one device included in the indoor wireless network to an indoor network coordinator (S511), sending by the indoor network coordinator the wireless signal to an indoor unit through the indoor wireless network (S530), and sending by the indoor unit the received wireless signal to the outdoor unit or another indoor unit (S540).

Figure 21:
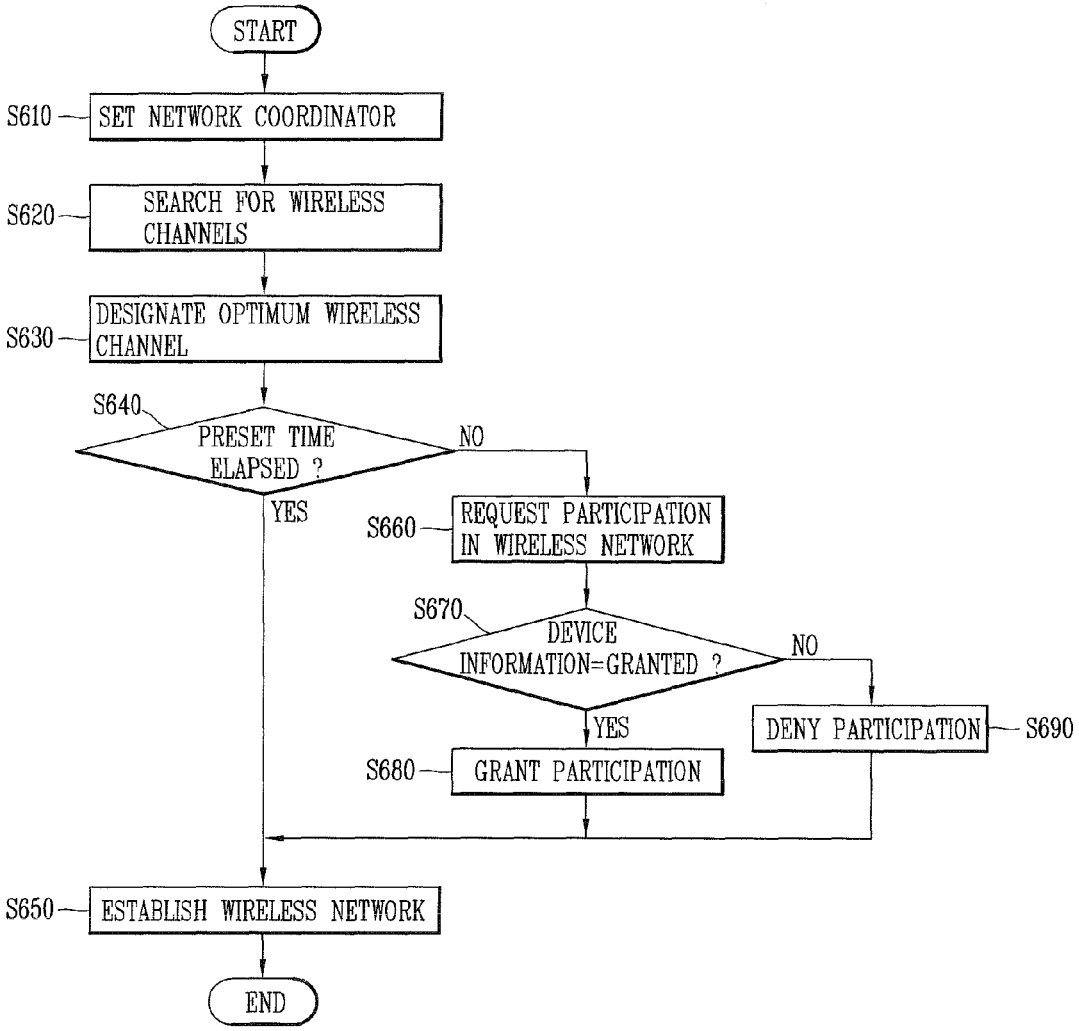
FIG. 21 is a flowchart showing an exemplary operation of allowing a device to participate in the wireless network in the communication method shown in FIGS. 18 to 20.

Here, referring to FIG. 21, the establishing of the indoor wireless network may include searching for wireless channels by the indoor network coordinator (S620), designating by the indoor network coordinator an optimum wireless channel among the wireless channels (S630), receiving by the indoor network coordinator a request for participation in the indoor wireless network sent by another device (S660), and granting or denying the participation of the another device based upon information related to the another device (S670 to S690). The air conditioner may establish the indoor wireless network through those processes.

Referring to FIG. 20, the communication method for the air conditioner may further include establishing an outdoor wireless network by a plurality of outdoor units (S520), and sending the wireless signal from one of the outdoor units to another outdoor unit (S550). Also, the communication method may further include setting one of the plurality of outdoor units included in the outdoor wireless network as an outdoor network coordinator. Here, referring to FIG. 21, the establishing of the outdoor wireless network may include searching for wireless channels by the outdoor network coordinator (S620), designating by the outdoor network coordinator an optimum wireless channel among the wireless channels (S630), receiving by the outdoor network coordinator a request for participation in the outdoor wireless network sent by another outdoor unit, which is not the outdoor network coordinator (S660), and granting or denying the participation of the another device based upon information related to the another outdoor unit (S670 to S690). The air conditioner may establish the outdoor wireless network through those processes.

For example, referring to FIG. 10, the outdoor units 200*a* and 200*b* may establish the outdoor wireless network B. The air conditioner may include an outdoor network coordinator disposed within the outdoor wireless network for performing communications within the outdoor wireless network and granting or denying participation of other devices in the outdoor wireless network. The outdoor network coordinator may handle transmission and reception of data or signals between the outdoor units, and control participation or non-participation of another outdoor unit in the outdoor wireless network. Here, the outdoor network coordinator may be an outdoor unit adjacent to the controller.

Referring to FIG. 11, in the air conditioner, the indoor wireless network A may be established between the plurality of controllers 300*a* to 300*d* and the indoor unit 100*i* (SS510), and the outdoor wireless network B may be established among the plurality of outdoor units 200*a* to 200*c* (S520). Here, one of the plurality of controllers, for example, a master controller may be the indoor network coordinator (S511), and the outdoor unit 200*c*, which is connected to an indoor unit having the communication unit 400, namely, the indoor unit 100*i* establishing the indoor wireless network A via the refrigerant pipe 500, may serve as the outdoor network coordinator (S521). For example, if the controller 300*a* tries to send a control command to the indoor unit 100*a*, the controller 300*a* may convert the control command into a wireless signal to send to the indoor unit 100*d*, present within the indoor wireless network, via the established indoor wireless network using wireless communication technology (S530). Here, the controller 300*a* may be set as the indoor network coordinator (S511). The communication unit 400 of the indoor unit 100*d*, which received the wireless signal, may convert the wireless signal into a pipe communication signal or a dedicated line communication signal (S541, S542). The indoor unit 100*d* may transfer the pipe communication signal or the dedicated line communication signal to the outdoor unit 200*c* connected thereto via the refrigerant pipe 500 or the dedicated line 600 (S543). Here, the outdoor unit 200*c* may be set as the outdoor network coordinator (S521). Upon receiving the pipe communication signal or the dedicated line communication signal, the outdoor unit 200*c* may convert the same back into the wireless signal (S551), and send the wireless signal to the outdoor unit 200*a*, to which the corresponding (target) indoor unit 100*a* may be connected (S552). Upon receiving the wireless signal, the outdoor unit 200*a* may convert the wireless signal into the pipe communication signal or the dedicated line communication signal to send to the corresponding indoor unit 100*a* (S555). The indoor unit 100*a* may then perform the control command.

Referring to FIG. 20, the communication method may further include repeating by an outdoor unit, which is not set to the outdoor network coordinator, the wireless signal sent by the outdoor network coordinator (S553, S554). Referring to FIG. 13, three outdoor units 200*a* to 200*c* may establish an outdoor wireless network and the outdoor unit 200*a* may be set as the outdoor network coordinator. However, if a certain outdoor unit 200*c* is farther away from the outdoor network coordinator or direct communication is disabled due to an obstacle or the like, namely, if data repeater is required, a repeating unit may be used to receive a signal or data from the outdoor network coordinator and reproduce the signal or data to send to the corresponding outdoor unit (S554).

The foregoing embodiments have used the pipe communication technology or dedicated line communication technology together with the wireless communication technology, but any other wired/wireless communication technologies, such as power line communication technology or the like, may also be employed.

As described above, in the air conditioning system and the communication method thereof, a wireless network may be established between indoor units and a controller or between outdoor units so as to allow communications, which may facilitate device addition or device deletion. Also, one or more outdoor units and a plurality of indoor units may be controlled without a dedicated communication line or with using less amount of the dedicated communication line. The outdoor units or indoor units may perform communications using a plurality of communication technologies, such as wireless communication and pipe communication technologies and wireless communication and dedicated line communication technologies, and also perform communications with the controller using the wireless communication technology, thereby enhancing system operation efficiency irrespective of installation environments, resulting in improving stability of the system.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An air conditioning system comprising:

a plurality of indoor units for air conditioning;

a plurality of outdoor units connected to some or all of the plurality of indoor units via a refrigerant pipe and configured to drive the plurality of indoor units;

one or more controllers configured to control operations of the plurality of indoor units and the plurality of outdoor units; and a communication unit connected to or equipped as part of the outdoor units or part of the indoor units, and configured to allow communications between the indoor units, the outdoor units, and the controllers using one or more communication technologies, wherein the one or more controllers sends a control command to one of plurality of indoor units, the indoor unit transfers the control command to a first outdoor unit connected to the indoor unit via a refrigerant pipe using a pipe communication technology, and the first outdoor unit transfers the control command to a second outdoor unit or to one of the plurality of indoor units as a target of the control command.

2. The system of claim 1, wherein the communication unit comprises a first wireless communication module configured to allow communications between the outdoor units, the indoor units, and the controllers using a wireless communication technology.

3. The system of claim 2, wherein the communication unit further comprises a pipe communication module configured to allow communications between the outdoor units and the indoor unit using a pipe communication technology.

4. The system of claim 2, wherein the communication unit further comprises a dedicated line communication module configured to allow communications between the outdoor units and the indoor units using a dedicated line communication technology.

5. The system of claim 2, wherein the controller comprises a second wireless communication module configured to perform communications with the first wireless communication module using a wireless communication technology.

6. The system of claim 1, wherein the controller establishes an indoor wireless network with part of the indoor units and performs communications via the indoor wireless network.

7. The system of claim 6, further comprising an indoor network coordinator disposed within the indoor wireless network and configured to perform communications therein, the indoor network coordinator granting or denying participation of another device in the indoor wireless network.

8. The system of claim 1, wherein upon including a plurality of outdoor units, the outdoor units establish an outdoor wireless network.

9. The system of claim 8, further comprising an outdoor network coordinator disposed within the outdoor wireless network and configured to perform communications therein, the outdoor network coordinator granting or denying participation of another device in the outdoor wireless network.

10. The system of claim 9, further comprising a repeating unit configured to receive and reproduce a signal sent by the outdoor network coordinator and transfer the reproduced signal to another outdoor unit.

11. A communication method for an air conditioning system, the air conditioning system comprising a plurality of indoor units for air conditioning, a plurality of outdoor units connected to the indoor units via a refrigerant pipe to drive the indoor units, and a controller configured to control operations of the indoor units and the outdoor units, the method comprising:

converting a control command into a wireless signal;

sending the wireless signal to one of the plurality of indoor unit units;

converting the wireless signal into a communication signal; and sending the communication signal to a first outdoor unit connected to the indoor unit via a refrigerant pipe using a pipe communication technology;

sending the communication signal to a second outdoor unit or to one of the plurality of indoor units as a target of the control command.

12. The method of claim 11, further comprising establishing an indoor wireless network between the controller and some of the indoor units, wherein the sending of the wireless signal is configured such that the controller sends the wireless signal to an indoor unit via the indoor wireless network, the indoor unit being located within the indoor wireless network.

13. The method of claim 12, further comprising setting one indoor unit present within the indoor wireless network as an indoor network coordinator.

14. The method of claim 13, wherein the establishing of the indoor wireless network comprises:

searching for wireless channels by an indoor network coordinator;

designating an optimum wireless channel among the wireless channels;

receiving a request for participation in the indoor wireless network from another device; and granting or denying participation based upon information related to the other device having sent the request.

15. The method of claim 11, further comprising:

establishing an outdoor wireless network among a plurality of outdoor units; and sending by one of the outdoor units the wireless signal to another outdoor unit.

16. The method of claim 15, further comprising setting one outdoor unit present within the outdoor wireless network as an outdoor network coordinator.

17. The method of claim 16, wherein the establishing of the outdoor wireless network comprises:

searching for wireless channels by an outdoor network coordinator;

designating by the outdoor network coordinator an optimum wireless channel among the wireless channels;

receiving by the outdoor network coordinator a request for participation in the outdoor wireless network from an outdoor unit, the outdoor unit having not been set as the outdoor network coordinator; and granting or denying by the outdoor network coordinator the participation based upon information related to the outdoor unit having sent the request.

18. The method of claim 17, further comprising repeating by the outdoor unit, having not been set as the outdoor network coordinator, the wireless signal sent by the outdoor network coordinator.

19. The method of claim 11, wherein the communication signal comprises a pipe communication signal, a dedicated line communication signal, and a power line communication signal.

* * * * *